US010278488B1

(12) United States Patent
Greeson

(10) Patent No.: US 10,278,488 B1
(45) Date of Patent: May 7, 2019

(54) BRUSH CLEANER

(71) Applicant: Allied Carriers, LLC, Simi Valley, CA (US)

(72) Inventor: Austin Greeson, Simi Valley, CA (US)

( * ) Notice: Subject to any disclaimer, the term of this patent is extended or adjusted under 35 U.S.C. 154(b) by 0 days.

(21) Appl. No.: 15/920,324

(22) Filed: Mar. 13, 2018

(51) Int. Cl.
*A46B 17/06* (2006.01)
*A46B 9/02* (2006.01)
*A45D 44/16* (2006.01)

(52) U.S. Cl.
CPC ..... *A46B 17/06* (2013.01); *A45D 44/16* (2013.01); *A46B 9/023* (2013.01); *A46B 9/028* (2013.01); *A45D 2200/25* (2013.01); *A46B 2200/104* (2013.01)

(58) Field of Classification Search
CPC ..... A46B 17/06; A46B 9/023; A46B 9/028; A45D 44/16
See application file for complete search history.

(56) References Cited

U.S. PATENT DOCUMENTS

| | | | | |
|---|---|---|---|---|
| 3,879,787 | A | 4/1975 | Russo | |
| 4,084,282 | A * | 4/1978 | Calvert | A45D 24/46 119/609 |
| 5,519,912 | A | 5/1996 | Kawamura | |
| 5,862,563 | A | 1/1999 | Hartmann | |
| 5,904,150 | A | 5/1999 | Caristo et al. | |
| 6,021,542 | A | 2/2000 | Norman | |
| 6,408,475 | B1 * | 6/2002 | Morrison | A46B 17/06 119/628 |
| 6,631,831 | B1 | 10/2003 | Loiselle | |
| 6,779,220 | B1 | 8/2004 | Raffa | |
| 9,198,499 | B2 * | 12/2015 | Kim | A46B 9/023 |
| 2005/0055786 | A1 | 3/2005 | Chang et al. | |
| 2007/0199170 | A1 | 8/2007 | DiPippo | |
| 2009/0000642 | A1 | 1/2009 | DiPippo | |

* cited by examiner

*Primary Examiner* — Shay Karls
(74) *Attorney, Agent, or Firm* — Norton Rose Fulbright US LLP

(57) ABSTRACT

The present disclosure relates to methods, devices, and systems for cleaning a brush. In an aspect of the present disclosure, a system includes the brush and a cleaner assembly. The brush includes a plurality of bristles and a channel. The cleaner assembly is configured to remove hair from the plurality of bristles. The cleaner assembly includes a frame and a flange coupled to the frame. The flange is configured to be inserted into and travel within the channel.

25 Claims, 30 Drawing Sheets

110

110

110

110

110
137
130
142

137
143
120

BRUSH CLEANER

TECHNICAL FIELD

The present disclosure generally relates to a brush cleaner, and, but not by way of limitation, to methods, devices, and systems for cleaning or removing hair from a brush.

BACKGROUND OF THE INVENTION

A brush, such as a hairbrush, is typically used in grooming and personal care applications for styling and detangling hair. In some situations, the brush can be used along with another device, such as spray bottle, a straightener, a blow dryer, and/or a curling iron. A conventional brush includes bristles, which can vary in size, shape, number, density, placement, etc., depending on the brush. During use of the brush, hair, hair product, or both often accumulate on the brush. For example, hair may become accumulated and entangled with the bristles thus creating a mat of hair. Overtime, a brush may become less effective during use as hair and/or hair product is accumulated by the brush and the brush has to be "cleaned" to remove the accumulated hair.

Cleaning a brush to remove hair and/or hair product from the brush is often a tedious and time consuming task, which can be made all the more difficult depending on the configuration and design of the brush and/or the bristles. Additionally, as a brush accumulates more and more hair over time, cleaning the brush becomes more difficult as the mat of hair in the bristles becomes thicker, denser, and/or more entangled. To clean the brush, a user may employ his or her fingers to physically remove the hair from the brush. Additionally, or alternatively, a device may be used to remove hair from and/or clean the brush. For example, a handle of a comb or other object is repeatedly inserted between the bristles and is operated to pry the hair from the bristles. As another example, rake-type devices have been designed to be raked several times across the bristles to loosen and remove hair from the brush. As another example, a brush may include a self-cleaning feature in which one or more plates are positioned near a base of the bristles and the plate is lifted to push and remove the hair from the bristles. Each of these conventional devices and/or techniques for cleaning a brush can vary in effectiveness, convenience, complexity, duration, and cost to implement based on one or more factors, such as a design/shape of the brush, a configuration of the bristles, an amount of hair to be removed, a combination thereof, or the like, as illustrative, non-limiting examples. For example, use of an object or a self-cleaning feature often requires several passes to remove a majority of the hair. In situations where a large amount of hair has accumulated (e.g., the mat of hair entangled by the bristles is quite thick), some objects or self-cleaning features or wholly ineffective and incapable of removing the hair without additional and, often, manual intervention, such as using applying a pair of scissor to the hair which pose a risk of injury to the user. Additionally, removal of the hair may damage one or more bristles and result in damage rendering the brush less effective and/or inoperable for future use.

SUMMARY

The present disclosure is generally related to systems, devices, and methods for cleaning a brush, such as a hairbrush. In an aspect of the present disclosure, a system includes the brush and a cleaner device. The brush includes a plurality of bristles and one or more channels (e.g., one or more grooves). In some implementations, the brush may further include a bristle portion having a surface and a particular channel may be a recessed portion of the surface of the bristle portion of the brush. To illustrate, the particular channel may extend between a first end of the bristle portion and a second end of the bristle portion. The bristle portion may be free from sharp edges and may be configured to not catch (e.g., snag) hair during use. Additionally or alternatively, the particular channel may be positioned between a first row of bristles and a second row of bristles. The brush device may be configured to be used with a blow dryer such that the brush (e.g., the bristle portion) and/or the plurality of bristles can withstand high heat of a blow dryer, such as high heat temperatures of greater than or equal to 150 degrees Fahrenheit. In some implementations, the bristle portion exhibit high thermal conductivity and, in a particular implementation, may include ceramic. In a particular implementation, a body of the bristle portion includes a metal, such as aluminum, that includes a ceramic coating that may be painted or powder coated onto a surface of the metal. Additionally, or alternatively, the plurality of bristles may include a thin gauge wire (e.g., 0.040 inches), such as an aluminum wire.

The cleaner device is configured to remove hair from the plurality of bristles. The cleaner device includes a frame and one or more flanges coupled to the frame. At least one flange of the one or more flanges may be configured to be inserted into and travel along the particular channel, to lift one or more hairs away from the surface of the bristle portion of the brush, or both. In some implementations, a first flange of the one or more flanges includes a cutter (e.g., an edge or a blade) configured to cut (e.g., break or tear) one or more hairs. The flange and cutter may be configured/designed such that user injury from the cutter is minimized. Additionally, or alternatively, a second flange of the one or more flanges may include a groove configured to collect the one or more hairs. The cleaner device may also include a plurality of protrusions coupled to the frame and configured to remove the one or more hairs from a plurality of bristles of the brush. At least a portion of the plurality of protrusions may be positioned between two flanges of the one or more flanges. At least one protrusion of the plurality of protrusions includes a cleaner bristle, a cleaner fin, a cleaner hook, or a combination thereof.

To clean the brush (e.g., to remove hair from the plurality of bristles), at least one flanges of the cleaner device may be inserted into a first end of a channel of the brush via a first end of the brush. The cleaner device and/or the brush may be moved to position the flange at a second end of the channel. As a position of the cleaner device changes (as the position of the flange changes from the first end of the channel to the second end of the channel), the one or more flanges of the cleaner device may cut and/or collect one or more hairs, the plurality of protrusions may remove the one or more hairs from the plurality of bristles, or both. The cleaner device may be removed from the brush via a second end of the brush and the one or more hairs collected and/or removed by the cleaner device may be discarded. In some implementations, the one or more hairs may be removed from the cleaner device manually or using forced air (e.g., a blow dryer).

The present disclosure describes systems, devices, and methods for cleaning a brush (e.g., removing hair from the brush). The systems, devices, and methods described herein advantageously provide an efficient and effective brush cleaner (e.g., a cleaner device). For example, the cleaner device is easy to operate and can clean (e.g., remove hair from) the brush in a single pass. To illustrate, the brush may have one or more built in features, such as one or more channels, to accommodate the cleaner device. The one or more channels may be configured to engage one or more corresponding structures (e.g., flanges) of the cleaner device and may direct a path of travel of the cleaner device along a length (along a longitudinal axis) of the brush. Additionally, a configuration of the cleaner device promotes hair removal from the brush even when the brush has accumulated a relatively large amount of hair. To illustrate, the cleaner device includes one or more flanges and/or protrusions that are configured to lift the hair away from a surface of the brush and away from the bristles of the brush. Additionally, the cleaner device is configured to cut one or more hairs during cleaning to make the hair easier to remove. For example, an amount of lift that the cleaner device can provide to hair may be limited if the hair is heavily entangled with the bristles of the brush and/or wraps around the brush. By cutting the hair, the hair is divided into small section that and be lifted and removed from the brush. In some implementations, the cleaner device is configured to cut one or more hairs as the cleaner device lifts/guides the one or more hairs towards the cutter. At least one pass of the cleaner device is necessary to remove hair from the brush. In some implementations, a single pass of cleaner device cleans the brush without damage to the bristles. Thus, the present disclosure provides the systems, devices, and methods described herein provide safe, convenient, simple, and efficient systems, devices, and methods for cleaning a brush as compared to conventional approaches.

In an aspect of the present disclosure, a system includes a brush and a cleaner device. The brush includes a plurality of bristles and a channel. The cleaner device configured to remove hair from the plurality of bristles. The cleaner device includes a frame and a flange coupled to the frame. The flange is configured to be inserted into and travel along the channel.

In another aspect of the present disclosure, a brush includes a plurality of bristles. The brush further includes a channel configured to receive a flange of a cleaner device and to enable the flange to travel along the channel. In some implementations, the brush may further include a bristle portion having a surface and the channel may include a recessed portion of the surface of the bristle portion.

In another aspect of the present disclosure, a cleaner device includes a frame and a first flange coupled to the frame. The first flange is configured to be inserted into and travel along a first channel of a brush. The flange includes a cutter configured to cut one or more hairs. The cleaner device further comprises a plurality of protrusions coupled to the frame. The plurality of protrusions is configured to remove the one or more hairs from a plurality of bristles of the brush.

In another aspect of the present disclosure, a method for cleaning a brush includes inserting a flange of the cleaner device into a first end of a channel of the brush via a first end of the brush. The method also includes moving the cleaner device, the brush, or both to position the flange at a second end of the channel. The method further includes removing the cleaner device via a second end of the brush.

In another aspect of the present disclosure, a method for operating a cleaner device includes engaging a flange of the cleaner device with a channel. The method also includes cutting, by the flange, one or more hairs between a first bristle of the brush and a second bristle of the brush. The method further includes removing, by the cleaner device, the one or more hairs from the first and second bristles.

The foregoing has outlined rather broadly the features and technical advantages of the present disclosure in order that the detailed description that follows may be better understood. Additional features and advantages will be described hereinafter which form the subject of the claims. It should be appreciated by those skilled in the art that the conception and specific examples disclosed may be readily utilized as a basis for modifying or designing other structures for carrying out the same purposes described herein. It should also be realized by those skilled in the art that such equivalent constructions do not depart from the spirit and scope of the disclosure as set forth in the appended claims. The aspects which are characterized herein, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE FIGURES

For a more complete understanding of the present example inventions, reference is now made to the following descriptions taken in conjunction with the accompanying figures, in which.

DETAILED DESCRIPTION OF THE INVENTION

Particular implementations of the present disclosure are described below with reference to the drawings. In the description, common features are designated by common reference numbers throughout the drawings. As used herein, various terminology is for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where."

As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). The term "coupled" is defined as connected, although not necessarily directly, and not necessarily mechanically; two items that are "coupled" may be unitary with each other. The phrase "and/or" means and or. To illustrate, A, B, and/or C includes: A alone, B alone, C alone, a combination of A and B, a combination of A and C, a combination of B and C, or a combination of A, B, and C. In other words, "and/or" operates as an inclusive or.

Further, a device or system that is configured in a certain way is configured in at least that way, but it can also be configured in other ways than those specifically described. The feature or features of one embodiment may be applied to other embodiments, even though not described or illustrated, unless expressly prohibited by this disclosure or the nature of a described implementation.

Figure 1A:
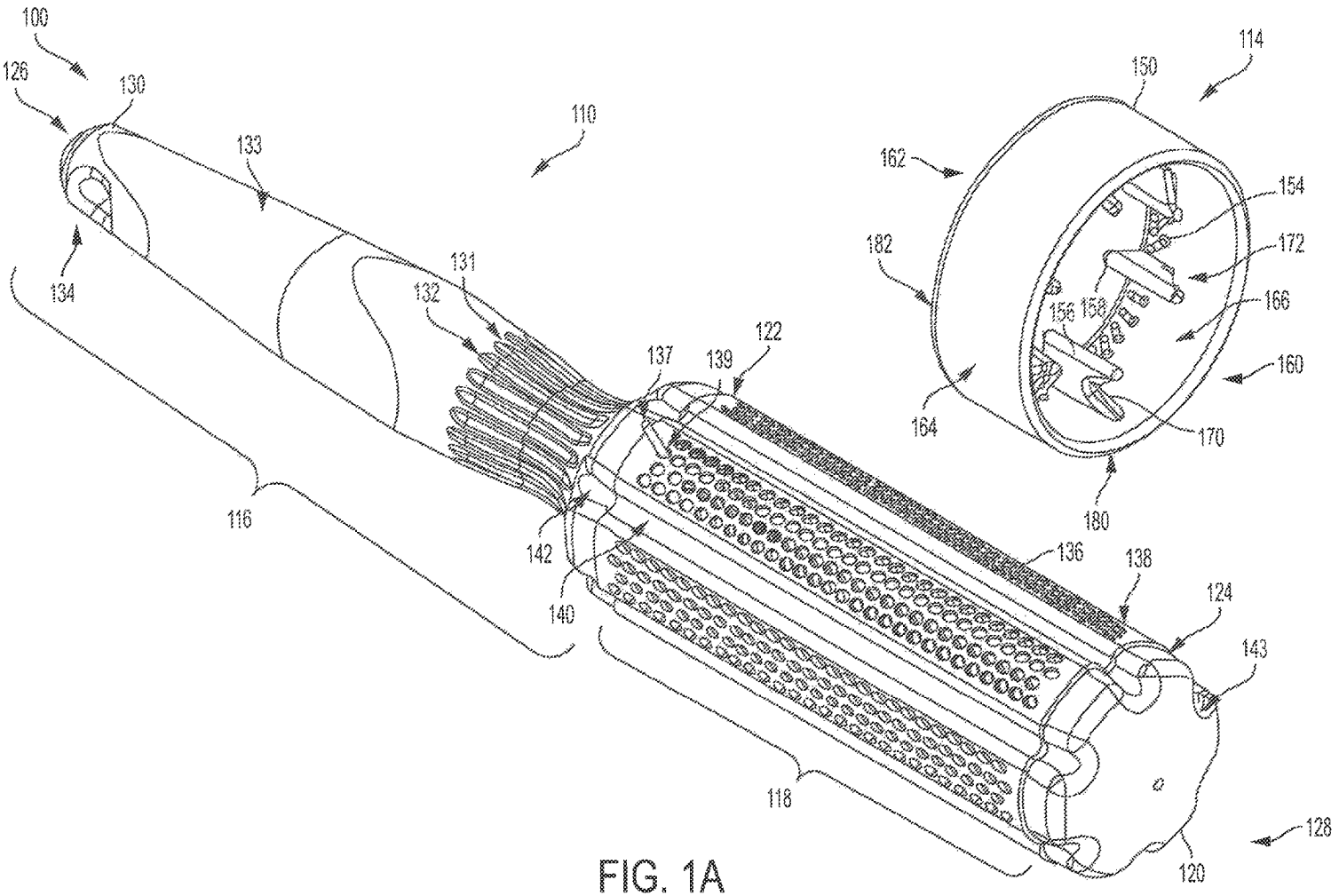
FIG. 1A illustrates a perspective view of an example of a system including a brush and a cleaner device.
Figure 1B:
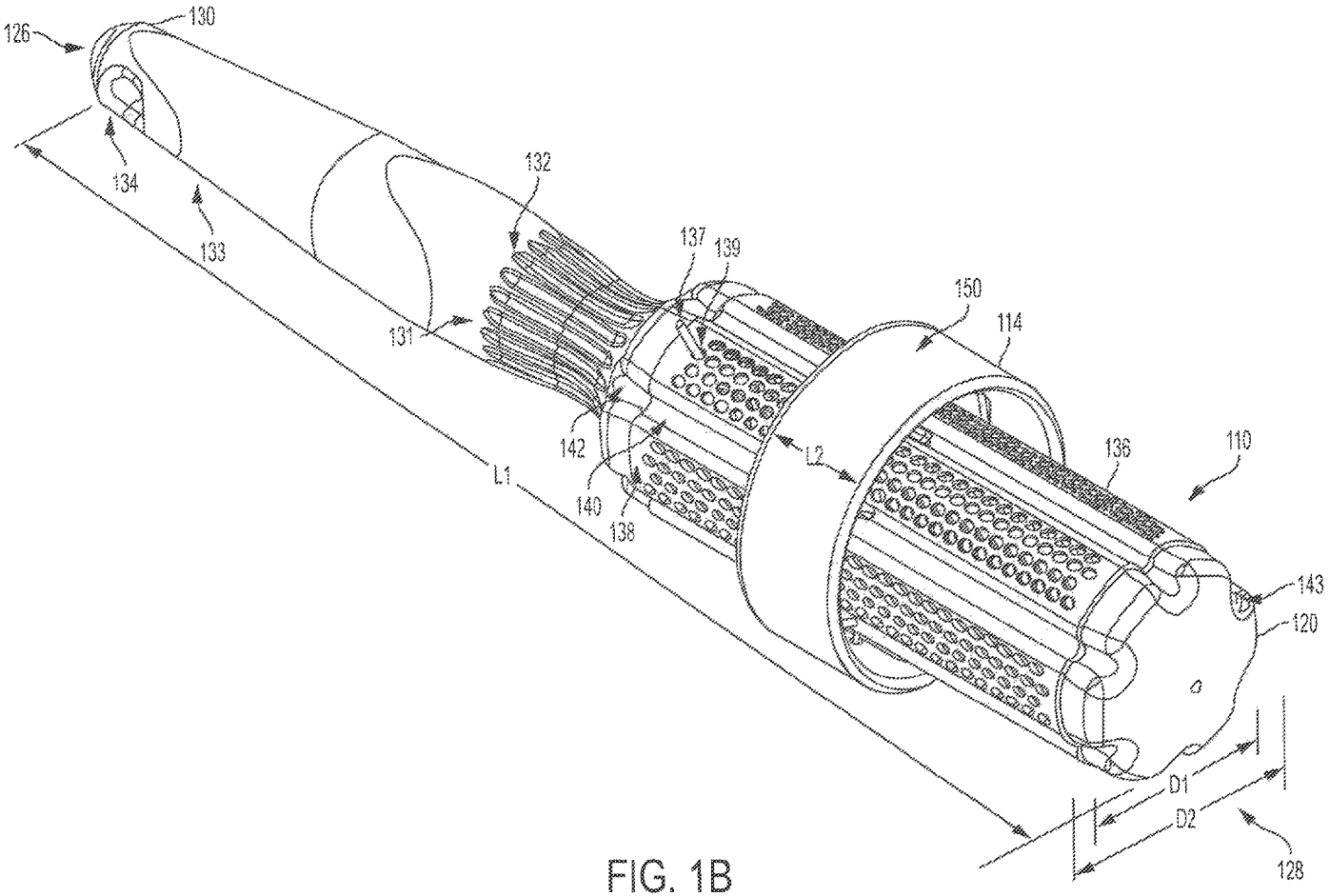
FIG. 1B illustrates a perspective view of another example of the system of FIG. 1A.
Figure 1D:
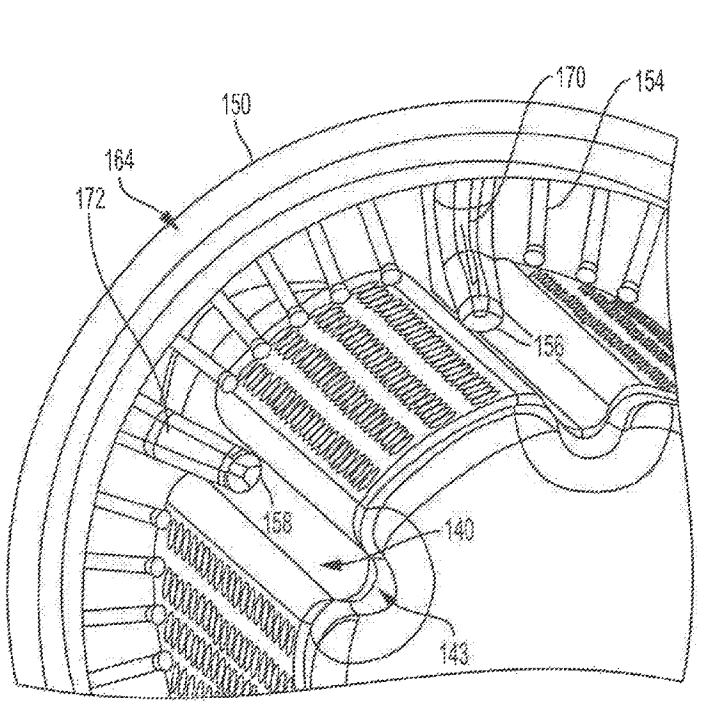
FIG. 1D illustrates an enlarged perspective view of a portion of the example of the system of FIG. 1B.
Figure 1C:
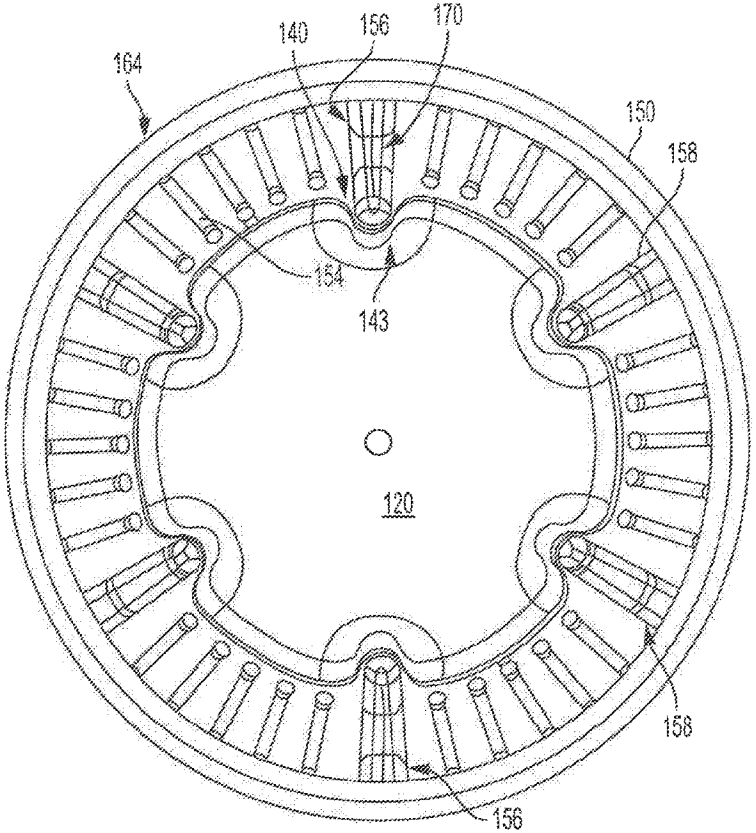
FIG. 1C illustrates an end view of the example of the system of FIG. 1B.
Figure 1E:
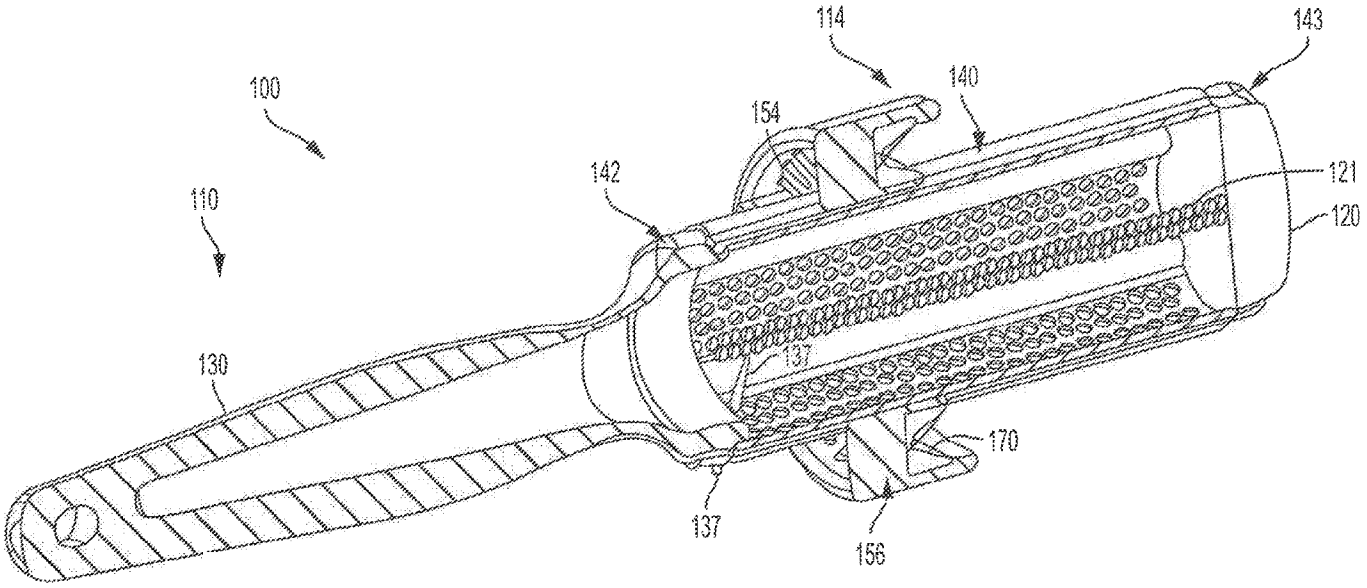
FIG. 1E illustrates a cross-section of a perspective view of the example of the system of FIG. 1B.

Referring to FIGS. 1A-1E, illustrative examples of aspects of a system 100 of the present disclosure is shown. FIG. 1A shows a perspective view of system 100 including a brush 110 and a cleaner device 114, FIG. 1B shows another perspective view of system 100, FIG. 1C shows an end view of system 100, FIG. 1D shows an enlarged perspective view of a portion of system 100, and FIG. 1E shows a cross-section of a perspective view of system along a longitudinal axis of brush 110. As used herein, a cleaner device may also be referred to as a cleaner assembly.

Figure 2A:
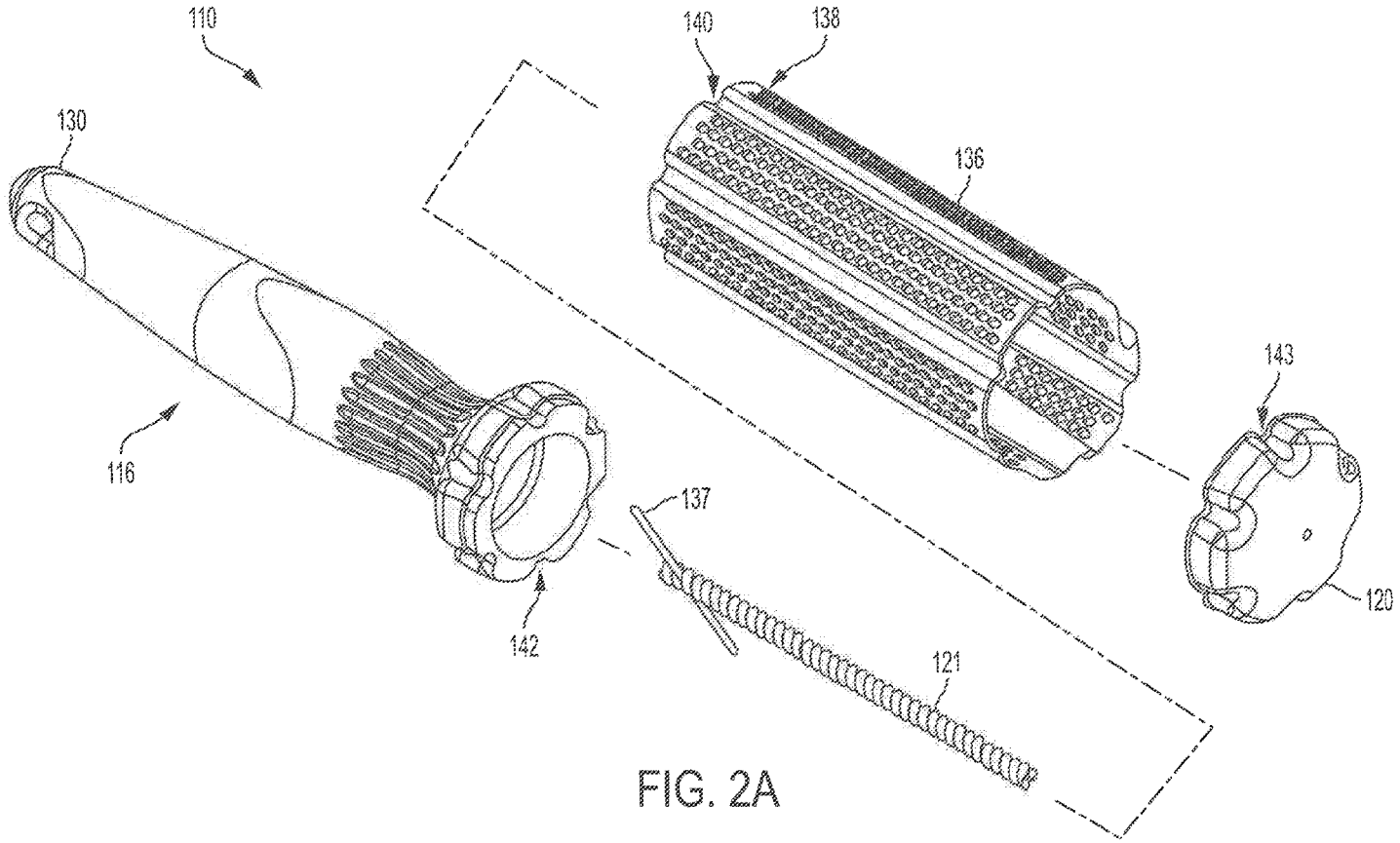
FIG. 2A illustrates an exploded view of the brush of FIG. 1A.
Figures 2B, 2C, 2D, 2E, 2F, 2G:
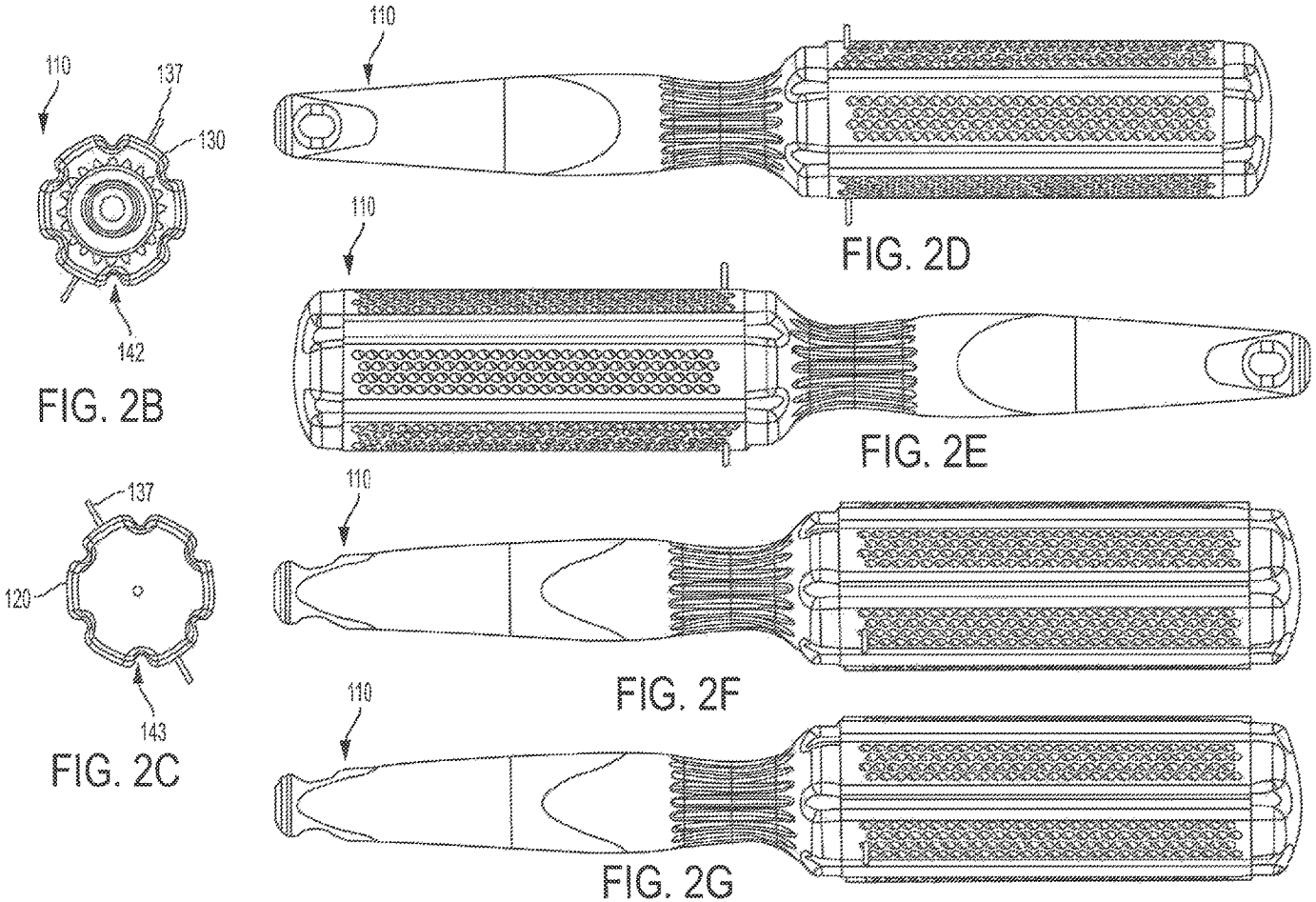
FIG. 2B illustrates an end view of the brush of FIG. 1A.
FIG. 2C illustrates another end view of the brush of FIG. 1A.
FIG. 2D illustrates a side view of the brush of FIG. 1A.
FIG. 2E illustrates another side view of the brush of FIG. 1A.
FIG. 2F illustrates a top view of the brush of FIG. 1A.
FIG. 2G illustrates a bottom view of the brush of FIG. 1A.
Figure 2H:
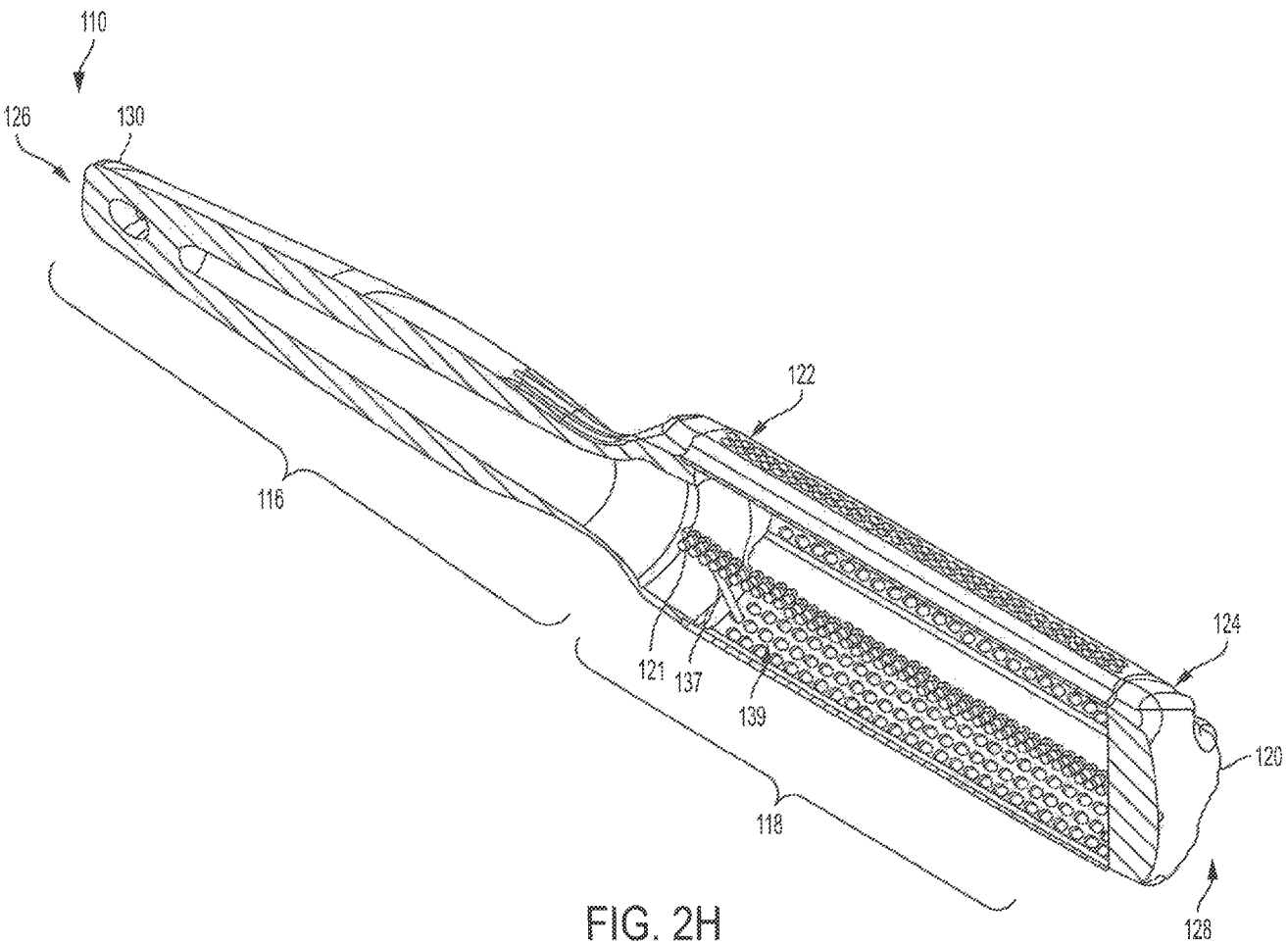
FIG. 2H illustrates a cross-section of a perspective view of the brush of FIG. 1A.

As shown in FIGS. 1A-1E, brush 110 includes a handle portion 116, a bristle portion 118, a cap 120, a coupler 121. Additional examples of brush 110 are described herein at least with reference to FIGS. 2A-2H. Referring to FIGS. 2A-2H, illustrative examples of aspects of brush 110 are shown. FIG. 2A shows an exploded view of brush 110, FIG. 2B shows an end view of brush 110, FIG. 2C shows another end view of brush 110, FIG. 2D shows a side view of the brush of FIG. 1A, FIG. 2E shows another side view of brush 110, FIG. 2F shows a top view of brush 110, FIG. 2G shows a bottom view of brush 110, and FIG. 2H shows a cross-section of a perspective view of brush 110.

Referring to FIGS. 1A-1E and FIGS. 2A-2H, brush 110 further includes a first end 126 and a second end 128 that is opposite the first end 126. As shown, first end 126 corresponds to handle portion 116 and second end 128 corresponds to cap 120. A longitudinal axis of brush 110 extends from first end 126 to second end 128. Brush 110 has a length L1 from first end 126 to second end 128 along the longitudinal axis of brush 110.

Coupler 121 is positioned within (e.g., extends through) bristle portion and is configured to be coupled to handle portion 116 and cap 120 (e.g., an end cap). For example, coupler 121 includes a first end coupled to handle portion 116 and a second end coupled to cap 120, such that bristle portion 118 is positioned intermediate handle portion 116 and the cap 120. Although a single coupler 121 is shown, in other implementations, brush 110 may include multiple couplers. In some implementations, coupler 121 includes or is incorporated in a screw, such as a plastic screw or a metal screw. In other implementations, brush 110 may include one or more screws coupled to handle portion 116 and/or cap 120, as described further herein at least with reference to FIGS. 7A-7C and 8A-8I. In such implementations, the one or more screws may be configured to secure bristle portion 118 between handle portion 116 and cap 120.

Handle portion 116 is coupled to bristle portion 118 at an interface 122 and bristle portion 118 is coupled to cap 120 at an interface 124. In some implementations, coupler 121 may be omitted from brush 110 and handle portion 116 and bristle portion 118, and/or bristle portion 118 and cap 120, may be permanently coupled (e.g., with an adhesive) or may have fittings to provide a snap coupling connection. Each of interface 122, 124 may provide a smooth and tight transition between coupled components such that hair does not catch or snag in interface 122, 124. Handle portion 116 includes a handle 130 including one or more ridges 131 and one or more valleys 132 defined therein. In some implementations, the one or more valleys may include or be filled in with a material, such as a rubber or polymer. The ridges 131 and valleys 132 may be configured a user to grip brush 110, such as gripping with a user's thumb. As shown, handle portion 116 includes molding 133 (e.g., rubber, polymer, etc.) coupled to or formed on a portion of handle 130. Handle portion 116 (e.g., handle 130) includes an opening 134 corresponding to a through hole of handle 130.

Bristle portion 118 includes a body 136 and a plurality of bristles, such as a representative bristle 137. It is noted that fewer than all of the plurality of bristles have been shown for ease of illustration. Brush 110 may be configured to be used with a blow dryer such that the brush (e.g., the bristle portion) and/or the plurality of bristles can withstand high heat of a blow dryer, such as high heat temperatures of greater than or equal to 150 degrees Fahrenheit. In some implementations, the bristle portion 118 may exhibit high thermal conductivity and, in a particular implementation, may include a ceramic or other thermally conductive material. In a particular implementation, body 136 includes a metal, such as aluminum, that includes a ceramic coating (or other thermally conductive material coating) that may be painted or powder coated onto a surface of the metal. Additionally, or alternatively, the plurality of bristles may include a thin gauge wire (e.g., 0.040 inches), such as an aluminum wire. Body 136 (e.g., bristle portion 118) may have a barrel shape or a flat shape (e.g., rectangular block shape, oval block shape, etc.). In some implementations, body 136 is hollow, which may promote air flow through body 136, avoid over heating of bristle portion, and/or reduce manufacturing costs. Body 136 includes a surface 138 having a plurality of openings, such as a representative opening 139, defined therein. In some implementations, surface 138 may be associated with or correspond to an outward facing surface and/or a surface that is positioned toward hair during use of brush 110.

Body 136 includes one or more channels, such as a representative channel 140. As shown, the one or more channels (e.g., 140) include recessed portions of surface 138 of bristle portion 118. For example, a particular channel (e.g., 140) is defined by one or more sidewalls of surface 138, a bottom wall of surface 138, or a combination thereof, such as both the one or more sidewalls and the bottom wall. In some implementations, brush 110 includes channels formed in different surfaces, as describe further with reference to at least FIGS. 13A-13C and 14A-14C. For example, a brush may have a bristle portion that includes multiple surfaces, such as a top surface, a bottom surface, an end surface, a side surface, or a combination thereof, as illustrative, non-limiting examples.

Channel 140 has a length that extends in the longitudinal direction of brush 110 from a first end (corresponding to interface 122) of bristle portion 118 (e.g., body 136) to a second end (corresponding to interface 124) of bristle portion 118 (e.g., body 136). As shown, first end of body 136 is opposite second end of body 136. As shown, each channel 140 is straight between first end of body 136 and second end of body 136. Additionally, or alternatively, at least one channel of the one or more channels may be curved (e.g., arched, sinusoidal, helical, etc.). Each of the channels 140 may be aligned with a corresponding lead in feature of handle portion 116 and a corresponding lead in feature of cap 120. For example, as shown, channel 140 is aligned with lead in feature 142 of handle portion 116 and with lead in feature 143 of cap 120. In some implementations, each lead in feature 142, 143 may be tapered to expand in a direction away from channels 140. A tapered configuration of the lead in features 142, 143 may enable easier and more efficient alignment of cleaner device 114 with the one or more channels (e.g., 140) as described further herein.

The plurality of bristles may be coupled to the coupler 121 at least a portion of each bristle (e.g., 137) of the plurality of bristles extends from or through surface 138 of body 136 (e.g., bristle portion 118). It is noted that coupler 121 may optionally be considered to be part of bristle portion 118. In some implementations, brush 110 may not include coupler 121, as described further herein at least with reference to FIGS. 12A-12D, 13A-13C, and 14A-14C. In such implementations, the plurality of bristles may be coupled to or otherwise secured to body 136.

The plurality of bristles (e.g., 137) and/or the plurality of openings (e.g., 139) may be arranged in a one or more rows, in a pattern, randomly, or a combination thereof. Accordingly, it is noted that the arrangement shown is not intended to limiting and other arrangements are possible. In a particular implementation, channel (e.g., 140 is a recessed portion of 138 and is positioned between a first set of bristles (e.g., a first row that extends from the first end of body 136 to the second end of body 136) of the plurality of bristles and a second set of bristles (e.g., a second row that extends from the first end of body 136 to the second end of body 136) of the plurality of bristles.

Body 136 may have a diameter D1 (e.g., a barrel diameter) in a plane that is perpendicular to the longitudinal axis of brush 110. The diameter D1 may include ½ inch, ¾ inch, 1 inch, 1⅜ inches, 1¾ inches, 2⅛ inches, 2½ inches, or 3⅛ inches, as illustrative, non-limiting examples. A diameter D2 (e.g., a bristle diameter) in a plane that is perpendicular to the longitudinal axis of brush 110 may correspond to a distance from a bristle tip of a first bristle (e.g., 137) to another bristle tip of a second bristle that is opposite the first bristle. The diameter D2 may include ⅞ inch, 1¼ inches, 1½ inches, 2 inches, 2⅜ inches, 3 inches, 3½ inches, or 4¼ inches. The diameter D2 is greater than the diameter D1.

Figure 3E:
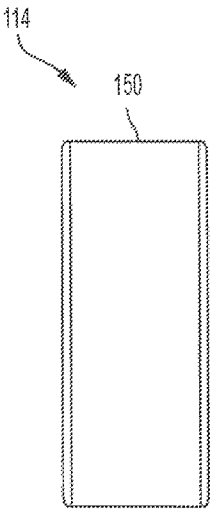
FIG. 3E illustrates a side view of the cleaner device of FIG. 3A.
Figure 3C:
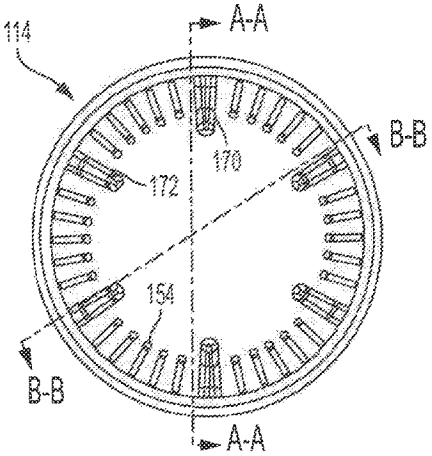
FIG. 3C illustrates a front view of the cleaner device of FIG. 3A.
Figure 3D:
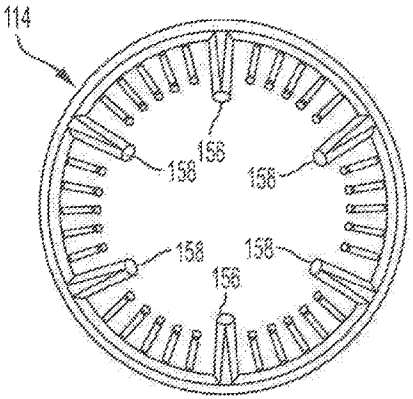
FIG. 3D illustrates a rear view of the cleaner device of FIG. 3A.
Figure 3A:
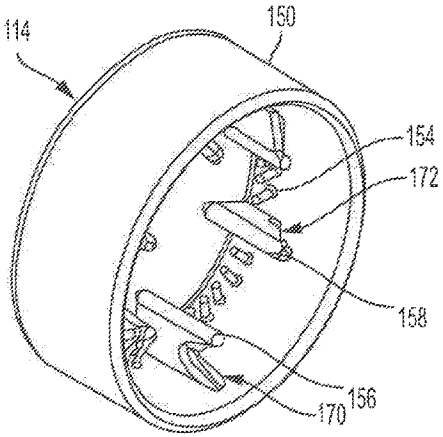
FIG. 3A illustrates a front perspective view of the cleaner device of FIG. 1A.
Figure 3B:
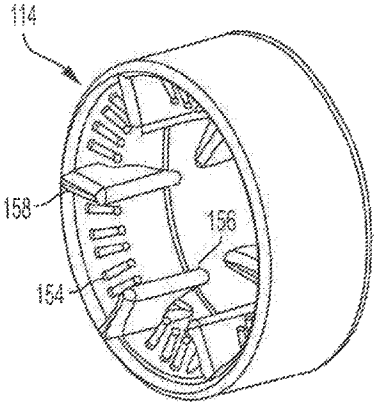
FIG. 3B illustrates a rear perspective view of the cleaner device of FIG. 3A.
Figure 3F:
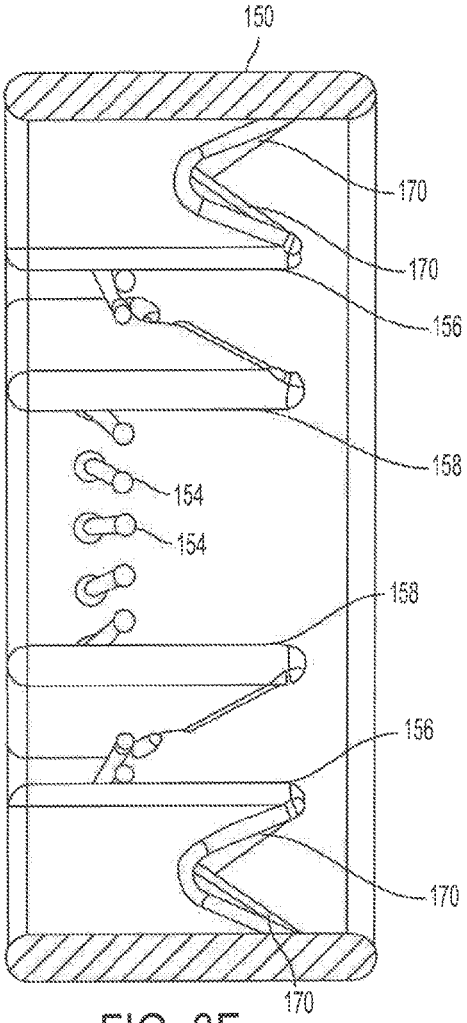
FIG. 3F illustrates a cross-sectional view of the cleaner device of FIG. 3A along A-A of FIG. 3C.

Referring to FIGS. 1A-1E, cleaner device 114 is configured to remove hair from plurality of bristles, as described herein. Additional, examples of cleaner device 114 are described herein, at least with reference to FIGS. 3A-3G. Referring to FIGS. 3A-3G, examples of aspects of cleaner device 114 are shown. FIG. 3A shows a front perspective view of cleaner device 114, FIG. 3B shows a rear perspective view of cleaner device 114, FIG. 3C shows a front view of cleaner device 114, FIG. 3D shows a rear view of cleaner device 114, FIG. 3E shows a side view of cleaner device 114, FIG. 3F shows a cross-sectional view of cleaner device 114, and FIG. 30 shows a cross-sectional view of cleaner device 114. Cleaner device 114 may include or be formed from a metal, an alloy, a plastic (e.g., a polymer), or a combination thereof.

Referring to FIGS. 1A-1E and 3A-3G, cleaner device 114 includes a frame 150, one or more protrusions 154, and one or more flanges, such as a representative first flange 156 and a representative second flange 158. For example, frame 150 may be coupled to the one or more protrusions 154 and to the one or more flanges. As shown, cleaner device 114 has a ring shape that is circular. In other implementations, the ring shape may be non-circular, as described with reference to FIGS. 12A-12D and 13A-13C. Alternatively, cleaner device 114 may have another shape (e.g., a non-ring shape), such as a U-shape, as an illustrative, non-limiting example. An example of a U-shape is describe with reference to FIGS. 14A-14C.

Cleaner device 114 (e.g., frame) further includes a first end 180 and a second end 182 that is opposite the first end 180. A longitudinal axis of cleaner device 114 extends from first end 180 to second end 182. Cleaner device 114 has a length L2 from first end 180 to second end 182 along the longitudinal axis of cleaner device 114. Length L2 may be large enough to provide a user to hold cleaner device 114 and to keep the user's hand free from contact with brush 110 as cleaner device 114 is operated to clean brush 110. In some implementations, length L2 may be equal to an end-to-end length (from interface 122 to interface 124) of bristle portion 118. Alternatively, length L2 may be greater than or less than the end-to-end length of bristle portion 118.

Frame 150 may include one or more outer surfaces, such as representative outer surface 164, and one or more inner surfaces, such as representative inner surface 166. In some implementations, a molding may be coupled to or formed on outer surface 164. Frame 150 may be coupled to one or more protrusions 154 and one or more flanges (e.g., 156, 158). The one or more protrusions and the one or more flanges may be positioned between the first opening 160 and the second opening 162. At least one of the one or more flanges (e.g., 156, 158) is configured to be inserted into and travel along one of the channels (e.g., 140). In some implementations, each of the one or more flanges is configured to be inserted into and configured to travel along the channels.

Figure 3G:
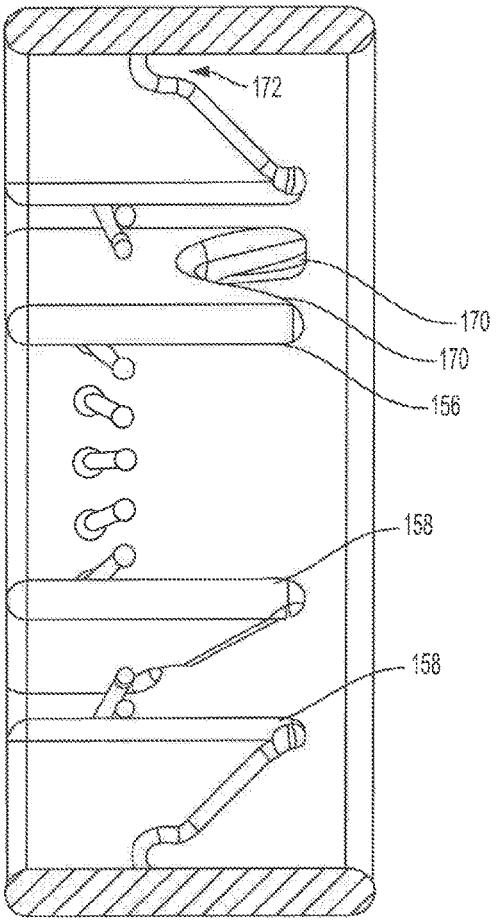
FIG. 3G illustrates a cross-sectional view of the cleaner device of FIG. 3A along B-B of FIG. 3C.

First flange 156 includes a cutter 170 configured to cut hair entangled in the plurality of bristles. For example, cutter 170 may include a first edge that faces first opening 160. Additionally, or alternatively, cutter 170 may include a second edge that faces first opening 160. In some implementations, cleaner device 114 may include a second cutter that includes an edge that faces second opening 162, as described further herein with reference to FIGS. 7A-7C and 9A-9H. The cutter(s) 170 may include one or more blades or may be formed by an edge of a flange structure, as illustrative, non-limiting example. As shown in FIG. 3F, flange 156 includes two blades having a "V" configuration. In some implementations, cutter 170 may be incorporated into or offset from a hair lift feature of a flange that includes the cutter. For example, as shown in FIG. 3F, one of the two blades may be configured to lift (e.g., guide) hair along the blade and towards the other blade. Second flange 158 includes a first groove 172 configured to collect one or more hairs. First groove 172 of second flange 158 face first opening 160. As shown in FIG. 3G, flange 158 includes a hair lift feature that lifts (e.g., guides) hair to groove 172, also referred to herein as a reservoir (e.g., a hair collection reservoir). In some implementations, second flange 158 includes a second groove configured to collect one or more hairs and that faces the second opening 162, as described further herein with reference to FIGS. 9A-9H. As shown, cleaner device 114 includes two flanges 156 having cutters 170 and four flanges 158 having grooves 172. In other implementations, a cleaner device 114 may include a single flange 156 having a cutter or more than two flanges 156 having cutters, may include fewer than four flanges 158 having grooves (e.g., In some implementations, cleaner device 114 may include fewer or more protrusions 14 than shown. Additionally, or alternatively, one or more of flange 156, flange 158, or a protrusion (e.g., 154) may include a rubber end to promote cleaning and removal of material and/or hair product coupled to surface 138 and/or within channels (e.g., 140).

The one or more protrusions 154 are configured to remove the one or more hairs from the plurality of bristles. At least one protrusion of the plurality of protrusions includes a cleaner bristle, a cleaner fin, a cleaner hook, or a combination thereof, as illustrative, non-limiting examples. In some implementations, the one or more protrusions are sized and/or positioned so as not to touch or otherwise contact surface 138. For example, as shown in FIG. 1C, protrusions 154 to not contact surface 138. As shown, each of the protrusions 154 extend the same height from surface 166. In other implementations, one or more of the protrusions 154 may extend different heights from surface 166. As shown in FIG. 1D, protrusions are aligned with gaps between bristles (e.g., gaps between openings defined in surface 138). Positioning protrusions 154 to be aligned with reduces and/or limits an opposing force provided by the bristles on cleaner device 114 as cleaner device travels along bristle portion 118.

Referring to FIGS. 4A-4F, illustrative stages of a method of operating system 100 are shown. The method of FIGS. 4A-4F may be performed using system 100 (e.g., brush 110 and cleaner device 114). For example, the method may be used to clean brush 110 (e.g., remove hair from the plurality of bristles) by passing brush 110 through cleaner device 114.

Figure 4A:
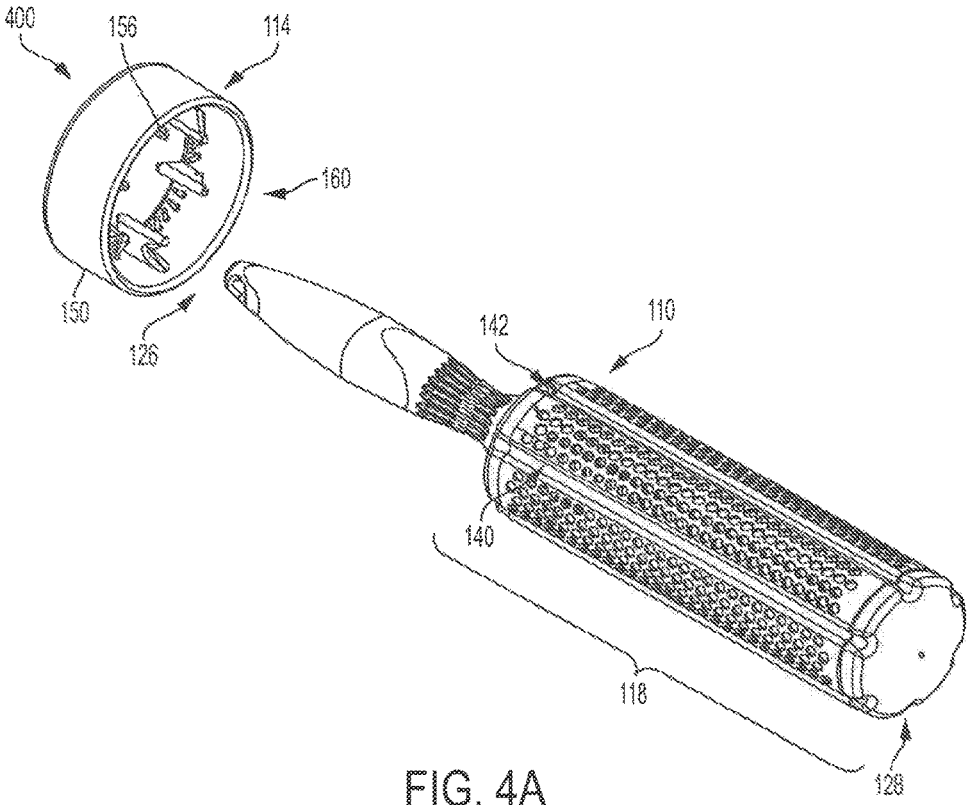
FIG. 4A illustrates an illustrative first stage of an example of a method of operating the system of FIG. 1A.

Referring to FIG. 4A, a first stage 400 of the method of operating system 100 is shown. At first stage 400, cleaner device 114 is positioned at first end 126 of brush 110 to be used to clean brush 110. For example, cleaner device 114 is positioned so first end 126 can pass through first opening 160 and then pass through second opening of cleaner device 114. Accordingly, a first end of frame 150 (corresponding to first opening 160) is positioned so that the first end faces a direction of travel of first flange 156 toward bristle portion 118.

Figure 4B:
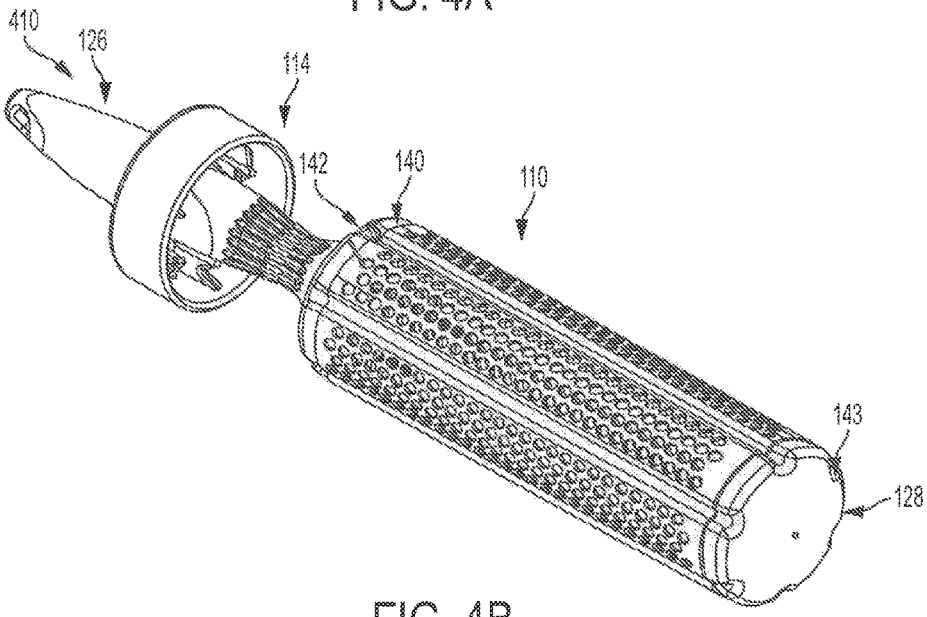
FIG. 4B illustrates an illustrative first stage of an example of a method of operating the system of FIG. 1A.

Referring to FIG. 4B, a second stage 410 of the method of operating system 100 is shown. At second stage 410, cleaner device 114 has advanced along handle portion 116 of brush 110 and is positioned to such that flange (e.g., 156, 158) is to be inserted into and travel along a corresponding channel of brush 110. For example, after cleaner device advances over first end 126 of brush 110, first flange 156 may be positioned to be inserted into channel 140 via a first end of channel 140.

Figure 4C:
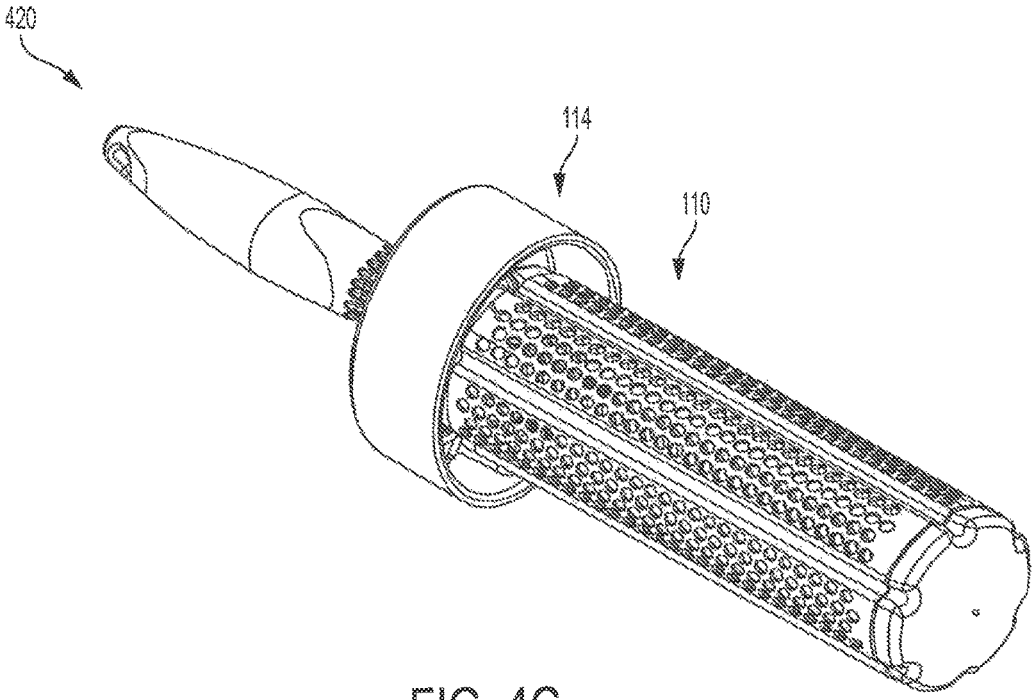
FIG. 4C illustrates an illustrative second stage of an example of a method of operating the system of FIG. 1A.

Referring to FIG. 4C, a third stage 420 of the method of operating system 100 is shown. At third stage 420, one or more flanges (e.g., 156, 158) has been engaged with one or more lead in features 142 of handle portion 116. The tapered configured of the lead in features 142, 143 may enable easier and more efficient alignment of cleaner device 114 with the one or more channels (e.g., 140) as a user does not have to exactly align a flange with the channel as the cleaner device is moved toward the bristle portion. Rather, a user aligns the flange with the larger tapered opening of the lead in feature and the lead in feature operates to guide and/or direct the flange into alignment with the channel.

Figure 4D:
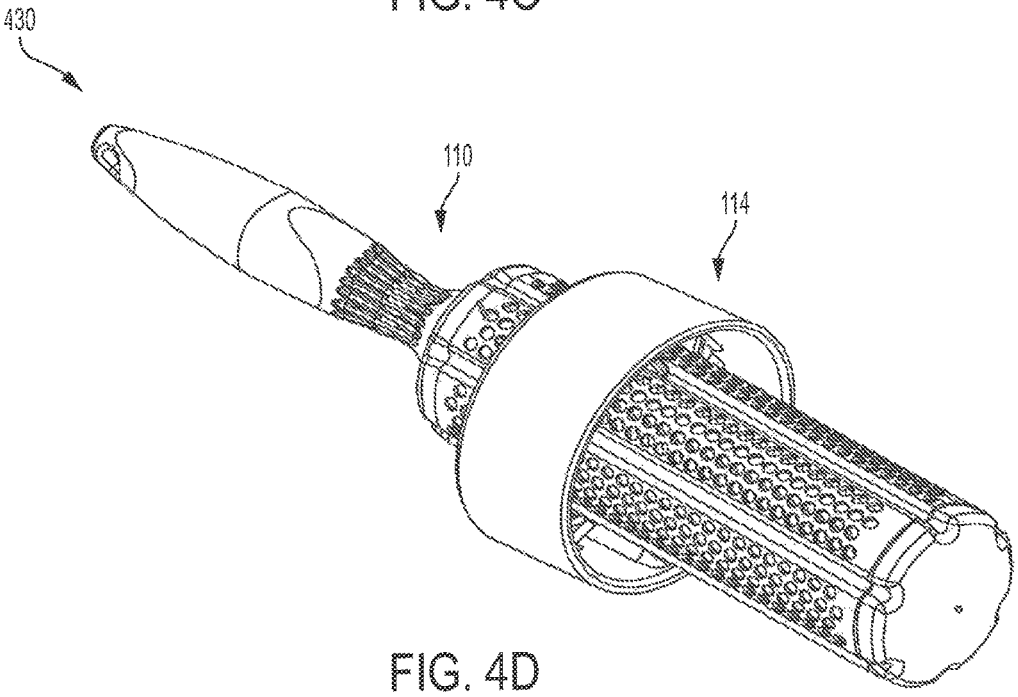
FIG. 4D illustrates an illustrative third stage of an example of a method of operating the system of FIG. 1A.

Referring to FIG. 4D, a fourth stage 430 of the method of operating system 100 is shown. At fourth stage 430, one or more flanges (e.g., 156, 158) has been engaged with one or more channels (e.g., 140) of brush 110 and has advanced along the one or more channels. To advance a position of cleaner device 114 with respect to brush 110, moving may occur by cleaner device 114, brush 110, or both. As cleaner device 114 advances, first flange 156 lifts and/or cuts one or more hairs between a first bristle of the brush 110 and a second bristle of the brush 110. The one or more hairs may be coupled to or otherwise entangled in the plurality of bristles of brush 110. Additionally, or alternatively, as cleaner device 114 advances, second flange 158 may lift the one or more hairs away from surface 138 and/or the one or more protrusions (e.g., 154) may remove the one or more cut hairs from the plurality of bristles. Cutting the hair reduces a tensile strength of the hair and improves efficiency of the hair by second flange 158 and protrusions 154, thus enabling cleaner device 114 to clean brush 110 in a single end-to-end pass. It is noted that in some implementations, bristles may be bent or otherwise pushed (in a direction of travel of cleaner device 114) by cleaner device 114 as cleaner device travels along bristle portion 118. Bending of the bristles may promote easier removal of hair from the bristles by cleaner device 114.

Figure 4E:
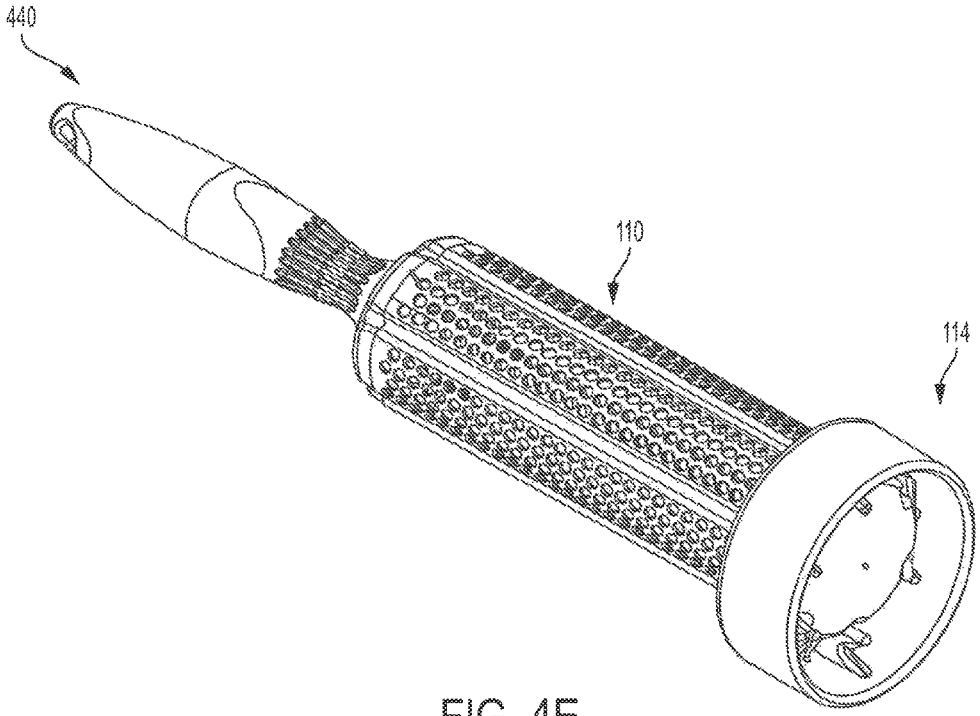
FIG. 4E illustrates an illustrative fourth stage of an example of a method of operating the system of FIG. 1A.
Figure 4F:
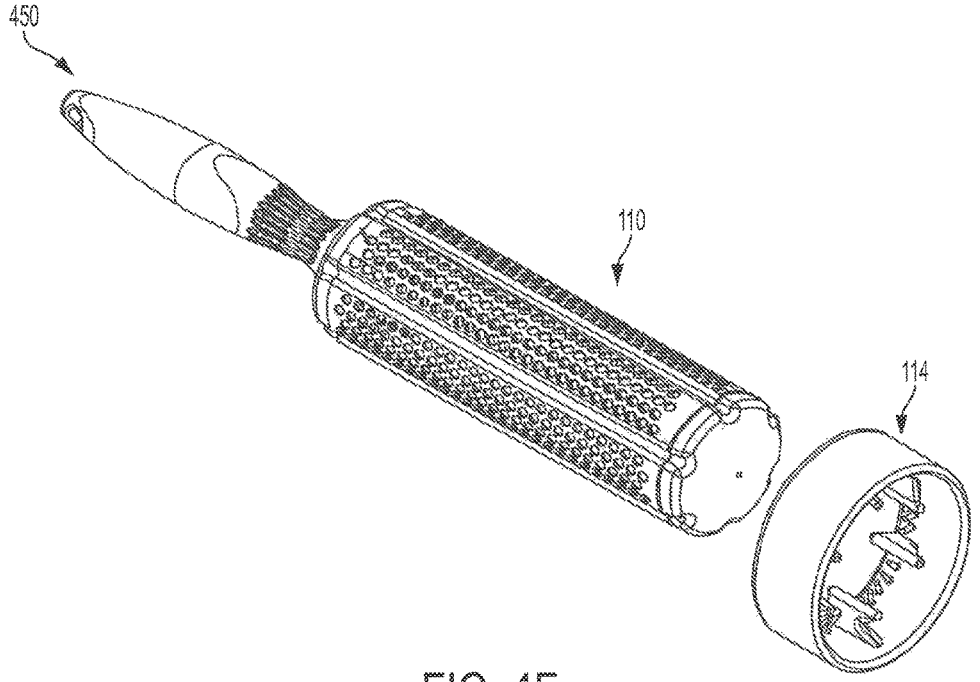
FIG. 4F illustrates an illustrative fifth stage of an example of a method of operating the system of FIG. 1A.

Referring to FIG. 4E, a fifth stage 440 of the method of operating system 100 is shown. At fifth stage 440, cleaner device is positioned at second end of bristle portion 118. Referring to FIG. 4F, a sixth stage 450 of the method of operating system 100 is shown. At sixth stage 450, cleaner device 114 has been removed from brush 110 via second end 128 of brush 110. One or more hairs collected by cleaner device 114 and removed from brush 110 may then be removed from cleaner device 114.

Referring again to FIGS. 1A-IF, in a particular implementation of system 100 including brush 110 and cleaner device 114, brush 110 includes plurality of bristles (e.g., 137) and channel (e.g., 140). Cleaner device 114 includes frame 150 and flange (156, 158) coupled to frame 150. Flange 156, 158 is configured to be inserted into and travel along channel (e.g., 140). In some implementations, brush 110 includes bristle portion 118 (e.g., body 136) having surface 138. At least a portion of each bristle (e.g., 137) of the plurality of bristles extends from or through surface 138 of bristle portion 118 (e.g., body 136). In such implementations, flange (156, 158) may be configured to lift the hair in a direction away from surface 138. Channel (e.g., 140) includes a recessed portion of surface 138. In some implementations, brush 110 further includes a second channel. The second channel may include a recessed portion of a second surface of the bristle portion of brush. The second surface of the bristle portion distinct may be distinct from the surface of the bristle portion, as describe at least with reference to FIGS. 13A-13C and 14A-14C.

In some implementations, brush 110 further includes a plurality of channels (that include the channel 140). Each channel is configured to receive the flange (e.g., 156, 158). In a particular implementation, cleaner device 114 includes a plurality of flanges and wherein the plurality of flanges is configured to be inserted into the plurality of channels. As shown, the plurality of flanges includes a first number of flanges and the plurality of channels includes a second number of channels, and wherein the second number of channels is greater than or equal to the first number of flanges.

In a particular implementation, a system 100 for removing hair accumulated in bristles (e.g., 137) of brush 110 includes brush 110 and a cleaner assembly (e.g., 114). Brush 110 includes a plurality of bristles (e.g., 137) and a channel (e.g., 140). Cleaner assembly extends about at least a partial circumference of brush 110. Cleaner assembly includes frame 150 and flange 156, 158 coupled to frame 150. Flange 156, 158 is configured to be inserted into and travel within channel 140 and lift hair in a direction away from brush 110 as flange 156, 158 travels within channel 140.

In another particular implementation, a system 100 for removing hair accumulated in bristles (e.g., 137) of brush 110 includes brush 110 and a cleaner assembly (e.g., 114). Brush 110 includes a plurality of bristles (e.g., 137) and a channel (e.g., 140). The plurality of bristles includes a first set of bristles and a second set of bristles. Each of the first set of bristles and the second set of bristles may include one or more bristles. Channel 140 may be positioned between the first set of bristles and the second set of bristles. For example, the channel 140 may include a recessed channel positioned between the first and second set of bristles. Cleaner assembly includes a flange 156, 156 configured to be inserted into and travel within channel 140. Cleaner assembly further includes a frame 150 coupled to the flange 1566, 158 and configured to extend about at least a partial circumference of brush 110 when flange 156, 158 is positioned within channel 158. Cleaner assembly may be configured to lift hair in a direction away from brush 110 as flange 156, 158 travels within channel 140. For example, the hair may be coupled to (e.g., extend between) the first and second set of bristles.

One advantage provided by the system 100 (e.g., brush 110 and cleaner device 114) is that the system 100 provides an efficient and effective brush cleaner (e.g., a cleaner device). For example, the cleaner device 114 is easy to operate and can clean (e.g., remove hair from) the brush in a single pass. To illustrate, brush 110 has one or more built in features, such as one or more channels (e.g., 140), to accommodate cleaner device 114. The one or more channels may be configured to engage one or more corresponding structures (e.g., flanges 156, 158) of cleaner device 114 and may direct or guide a path of travel of cleaner device 114 along a length (along a longitudinal axis) of brush 110. Additionally, cleaner device 114 promotes hair removal from brush 110 even when brush 110 has accumulated a relatively large amount of hair. To illustrate, cleaner device 114 includes one or more flanges (e.g., 156, 158) and/or protrusions (e.g., 154) that are configured to lift the hair away from surface 138 and away from the bristles of brush 110. Additionally, cleaner device 114 is configured to cut one or more hairs during cleaning to make the hair easier to remove. For example, an amount of lift that cleaner device 114 can provide to hair may be limited if the hair is heavily entangled with the bristles of brush 110 and/or wraps around brush 110. By cutting the hair, the hair is divided into small section that and be lifted and removed from brush 110. In some implementations, cleaner device 114 is configured to cut one or more hairs as cleaner device 114 lifts/guides the one or more hairs towards cutter 170. At least one pass of cleaner device 114 is necessary to remove hair from brush 110. In some implementations, a single pass of cleaner device 114 cleans brush 110 without damage to the bristles of brush 110. Thus, system 100 provides a safe, convenient, simple, and efficient devices and techniques for cleaning a brush as compared to conventional approaches.

Figure 5A:
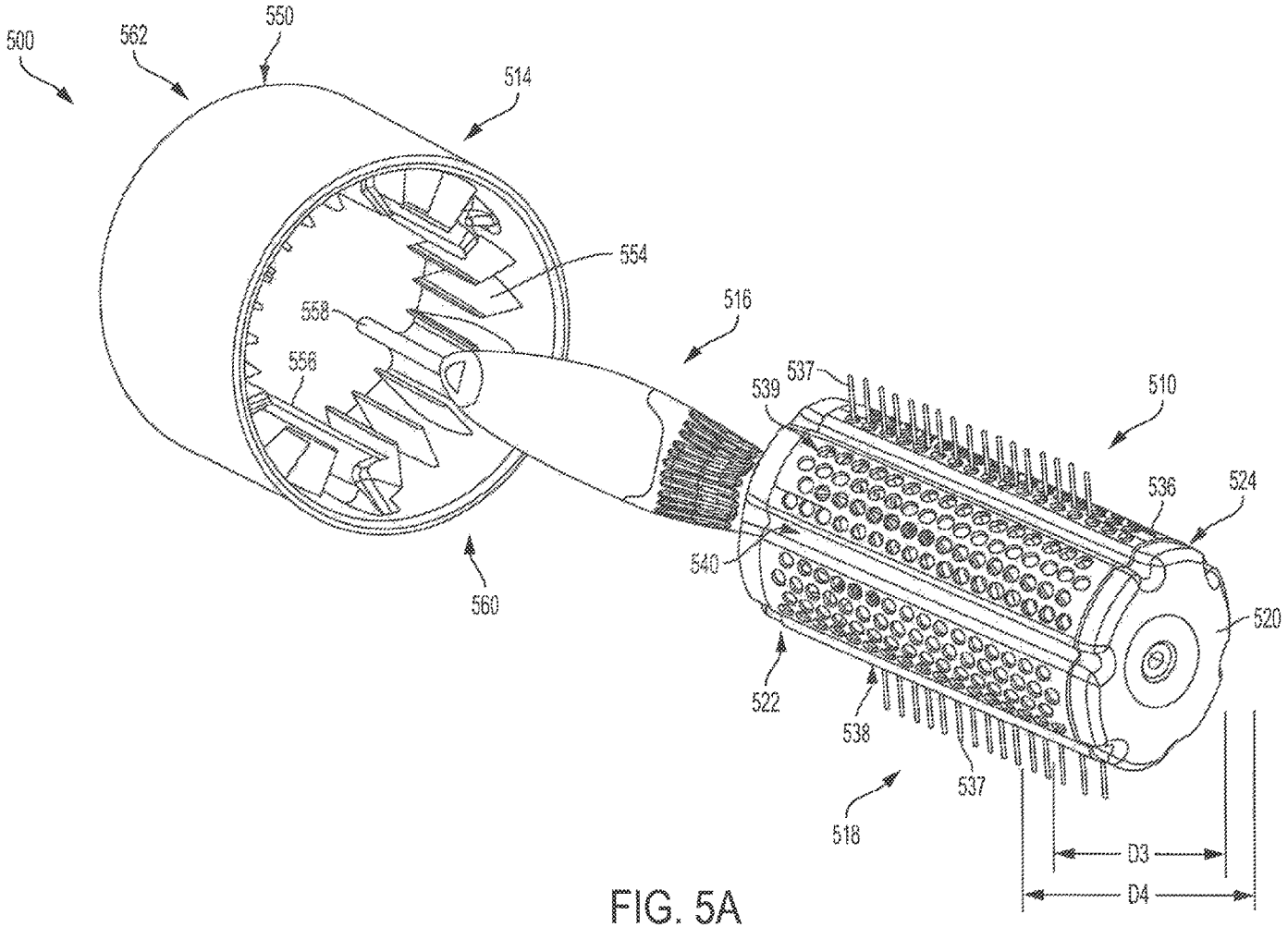
FIG. 5A illustrates a perspective view of another example of a system for cleaning a brush.
Figure 5B:
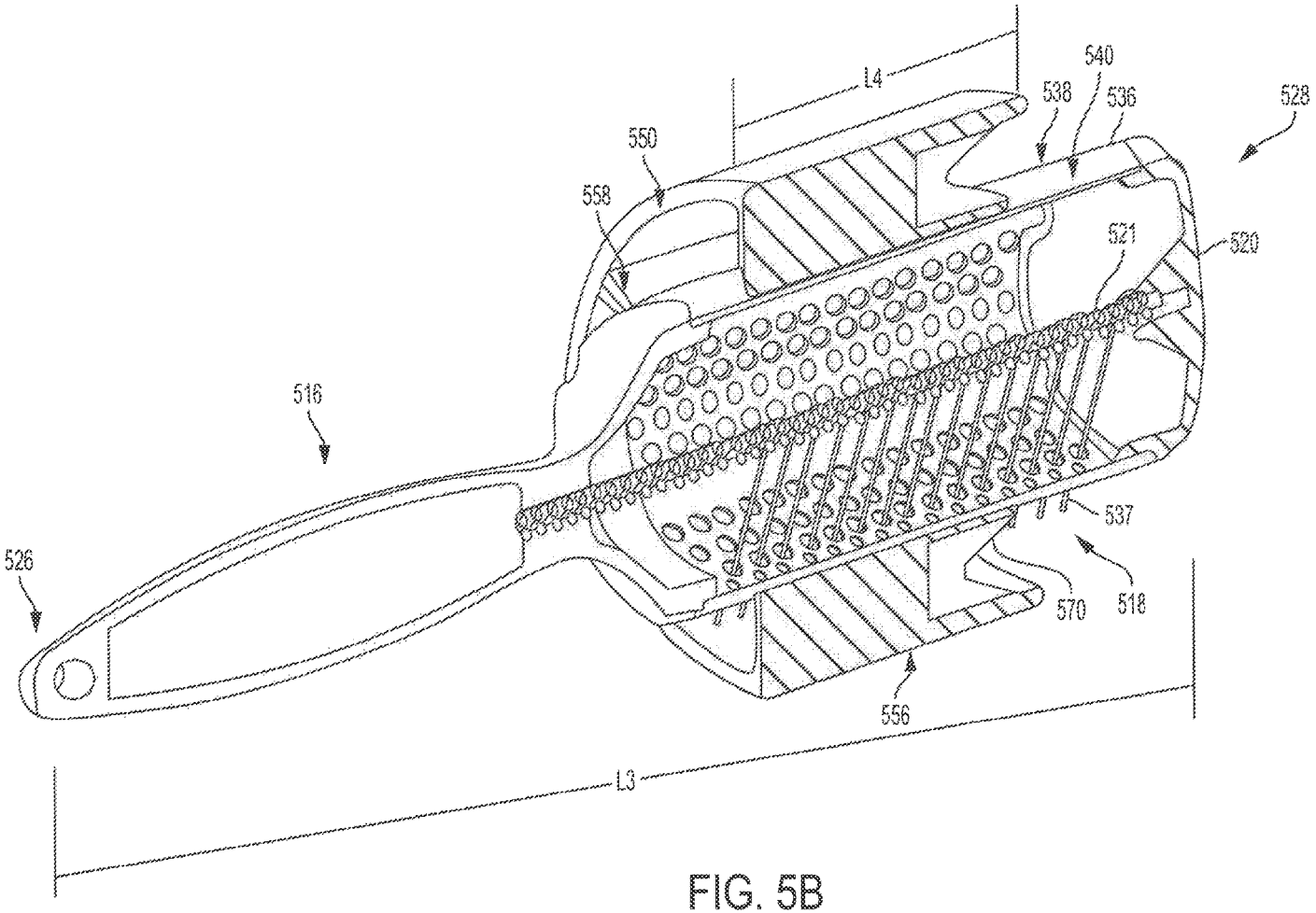
FIG. 5B illustrates a cross-section of a perspective view of the system of FIG. 5A.

Referring to FIGS. 5A-5B, examples of aspects of a system 500 of the present disclosure are shown. FIG. 5A shows a perspective view of system 500 and FIG. 5B shows a cross-section of a perspective view of system 500. System 500 includes a brush 510 and a cleaner device 514. System 500 may include or correspond to system 100 as described herein. For example, brush 510 may include or correspond to brush 110, and cleaner device 514 may include or correspond to cleaner device 114.

As shown in FIGS. 5A-5B, brush 510 includes a handle portion 516, a bristle portion 518, a cap 520, and a coupler 521. Handle portion 516, bristle portion 518, cap 520, and coupler 521 may include or correspond to handle portion 116, bristle portion 118, cap 120, and coupler 121, respectively. For example, handle portion 516 may include one or more features (e.g., ridges 131) as described with reference to handle portion 116. As another example, coupler 521 may be configured to be coupled to handle portion 516 and cap 520 in a manner that is the same as or similar to coupler 121 being coupled to handle portion 116 and to cap 120. Handle portion 516 is coupled to bristle portion 518 at an interface 522 and bristle portion 518 is coupled to cap 520 at an interface 524. As shown, handle portion 516 is hollow, which may contribute to design and/or manufacturing cost savings. Additionally, as shown, a longitudinal axis of brush 510 extends from a first end 526 to a second end 528 of brush 510. Brush 510 has a length L3 from first end 526 to second end 528 along the longitudinal axis of brush 510.

Bristle portion 518 includes a body 536 and a plurality of bristles, such as a representative bristle 537. It is noted that fewer than all of the plurality of bristles have been shown for ease of illustration. Body 536 includes a surface 538 having a plurality of openings, such as a representative opening 539, defined therein. Body 536 includes one or more channels, such as a representative channel 540. Body 536, surface 538, opening 539, and channel 540 may include or correspond to body 136, surface 138, opening 139, and channel 140. Body 536 may have a diameter D3 (e.g., a barrel diameter) in a plane that is perpendicular to the longitudinal axis of brush 510. A diameter D4 (e.g., a bristle diameter) in a plane that is perpendicular to the longitudinal axis of brush 510 may correspond to a distance from a bristle tip of a first bristle (e.g., 537) to another bristle tip of a second bristle that is opposite the first bristle. For example, diameter D3 and diameter D4 may include or correspond to diameter D1 and diameter D2, respectively.

Figure 6A:
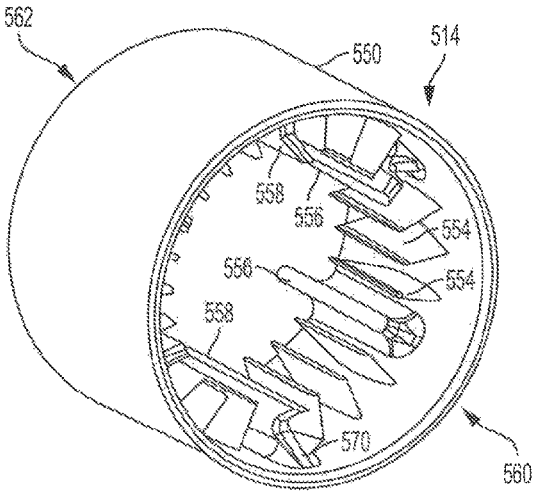
FIG. 6A illustrates a front perspective view of another example of a cleaner device of the system of 5A.
Figure 6C:
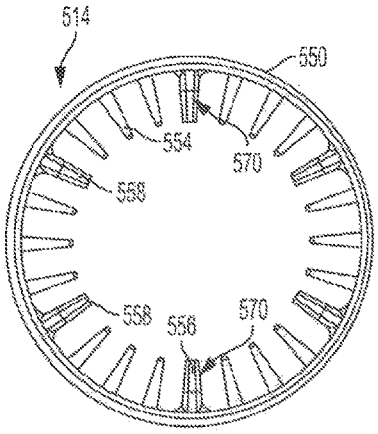
FIG. 6C illustrates a front view of the cleaner device of FIG. 6A.
Figure 6B:
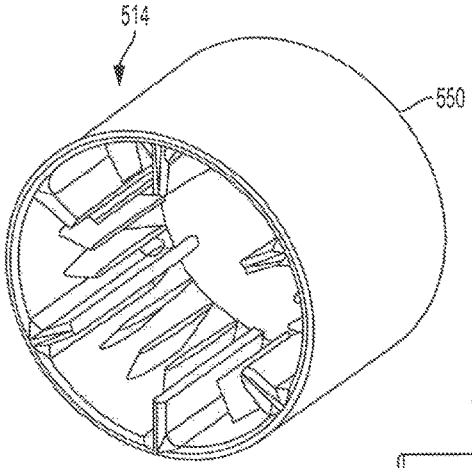
FIG. 6B illustrates a rear perspective view of the cleaner device of FIG. 6A.
Figure 6D:
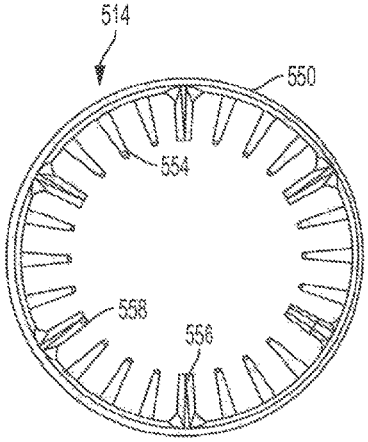
FIG. 6D illustrates a rear view of the cleaner device of FIG. 6A.
Figure 6E:
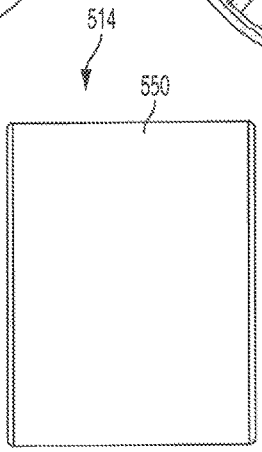
FIG. 6E illustrates a side view of the cleaner device of FIG. 6A.

Cleaner device 514 is configured to remove hair from plurality of bristles of brush 510. Additional, examples of cleaner device 514 are described herein, at least with reference to FIGS. 6A-6E. FIG. 6A shows a front perspective view of cleaner device 514, FIG. 6B shows a rear perspective view of cleaner device 514, FIG. 6C shows a front view of cleaner device 514, FIG. 6D shows a rear view of cleaner device 514, and FIG. 6E shows a side view of cleaner device 514.

Referring to FIGS. 5A-5B and 6A-6E, cleaner device 514 includes frame 550, one or more protrusions 554, and one or more flanges, such as a representative first flange 556 and a representative second flange 558. Frame 550, protrusions 554, and flanges 556, 558 may include or correspond to frame 150, protrusions 154, and flanges 156, 158, respectively. For example, flange 556 includes a cutter 570 (e.g., a cutter 170) configured to cut hair entangled in the plurality of bristles. Cutter 570 includes one or more edges, such as one or more blades, or cutter 570 is shaped/formed to have a sharp edge. As shown, protrusions 554 include a cleaner fin (e.g., a cleaner flange).

A longitudinal axis of cleaner device 514 extends from a first end 560 to a second end 562 of cleaner device 514. Cleaner device 514 has a length L4 from first end 560 to second end 562 along the longitudinal axis of cleaner device 514. Length L4 may be large enough to provide a user to hold cleaner device 514 and to keep the user's hand free from contact with brush 510 as cleaner device 514 is operated to clean brush 510. In some implementations, length L4 may be equal to an end-to-end length (from interface 522 to interface 524) of bristle portion 518. Alternatively, length L4 may be greater than or less than the end-to-end length of bristle portion 118. As compared to the cleaner device 114 (as shown) of system 100, cleaner device 514 of system 500 is larger in relation to bristle portion 518. However, it is noted that a size of cleaner device 114 and/or a size of cleaner device 514 is not intended to be limited or restricted.

One advantage provided by the system 500 (e.g., brush 510 and/or cleaner device 514) includes enabling efficient cleaning a brush (e.g., removing hair from the brush). For example, system 500 may clean (e.g., remove hair from) the brush in a single pass. Additionally, cleaner device 514 promotes hair removal from brush 510 during operation of the cleaner device 514 even when brush 510 has accumulated a relatively large amount of hair. To illustrate, during operation of cleaner device 514, cleaner device 514 may lift the hair away from surface 538 of brush 510 and away from the bristles of brush 510. Additionally, during operation of cleaner device 514, cleaner device 514 may cut one or more hairs during cleaning to make the hair easier to remove. Thus, system 500 enables safe, convenient, simple, and efficient techniques for cleaning a brush as compared to conventional approaches.

Figure 7A:
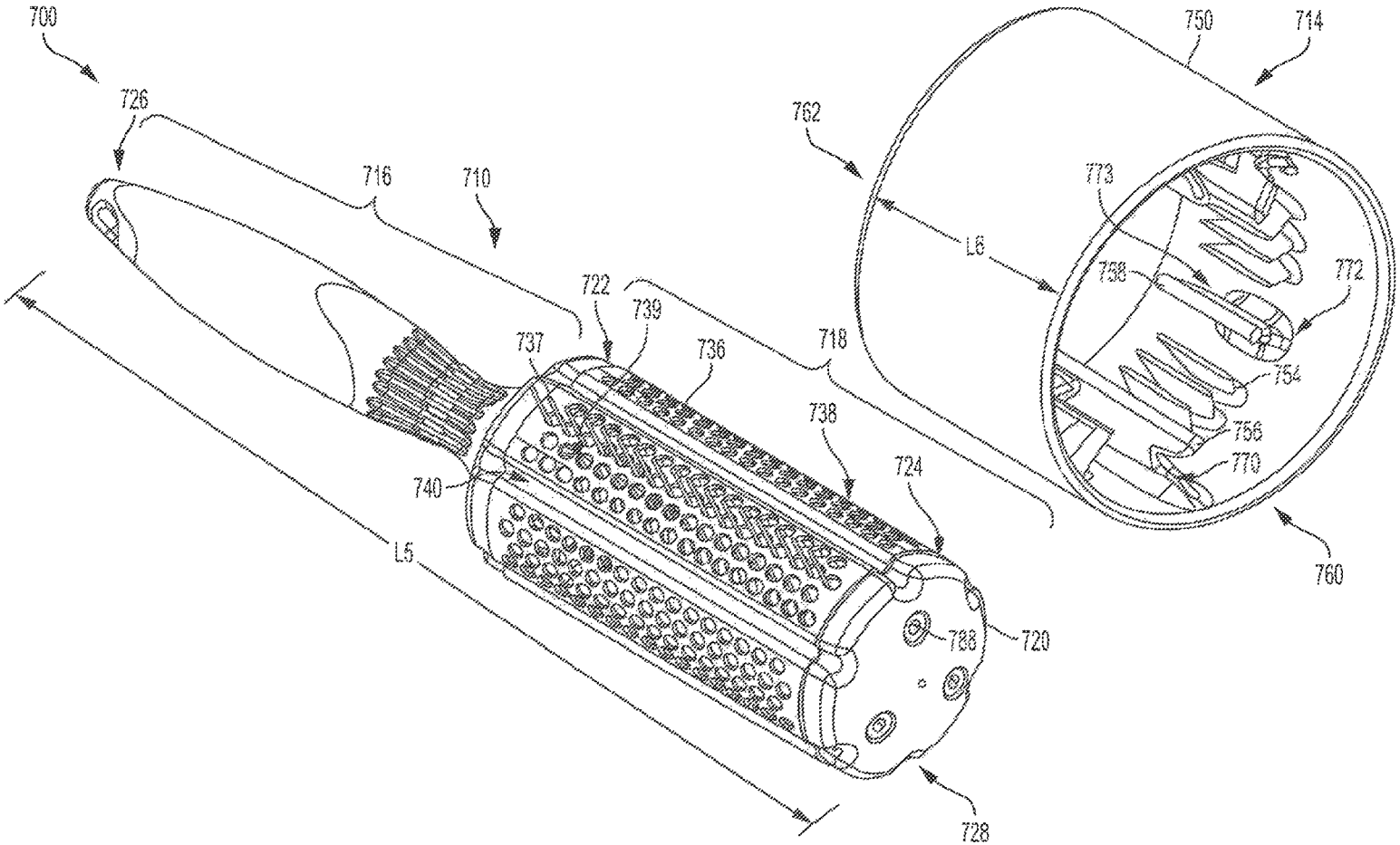
FIG. 7A illustrates a perspective view of an example of a system for cleaning a brush.
Figure 7B:
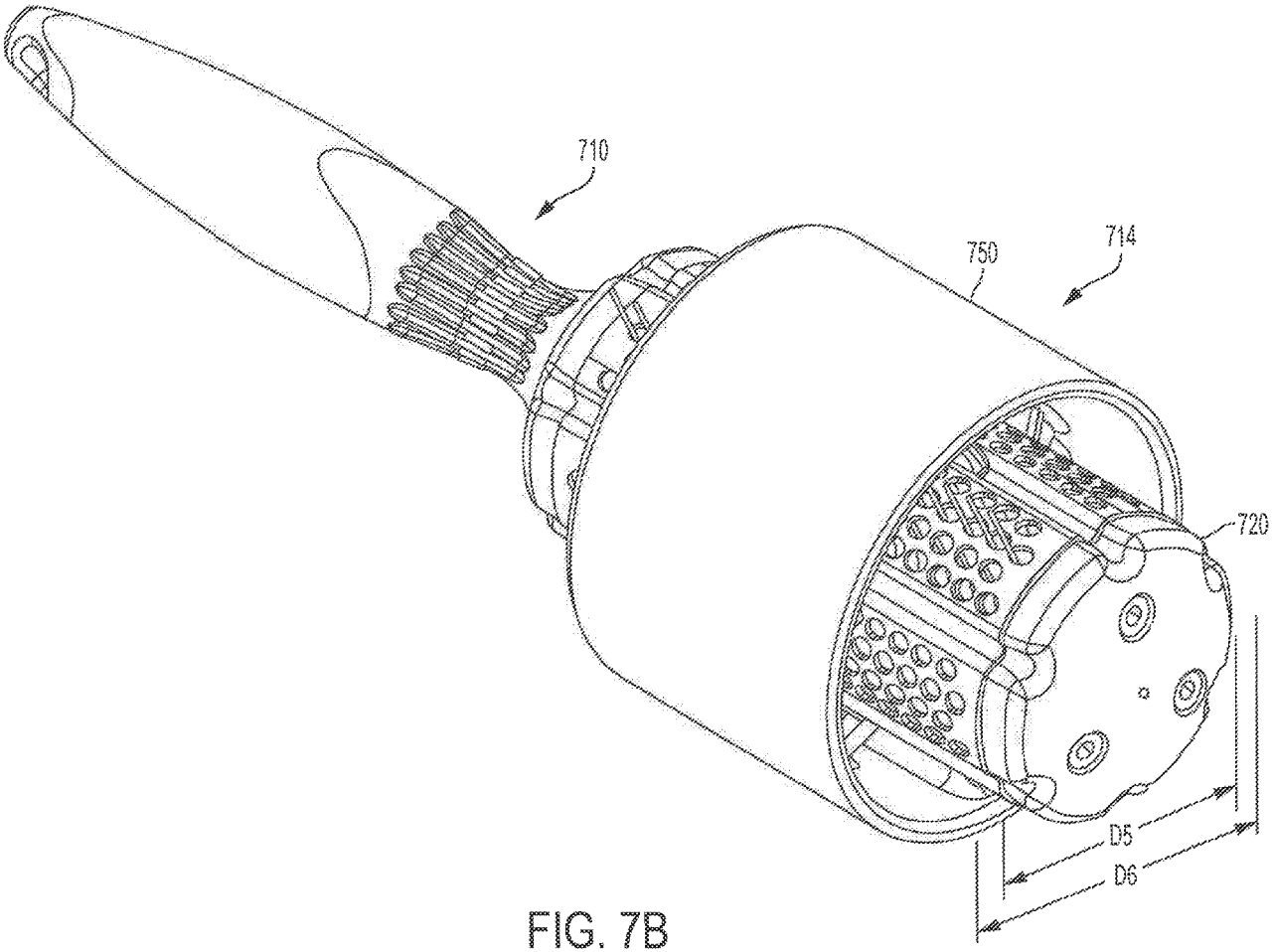
FIG. 7B illustrates a perspective view of another example of the system of FIG. 7A.
Figure 7C:
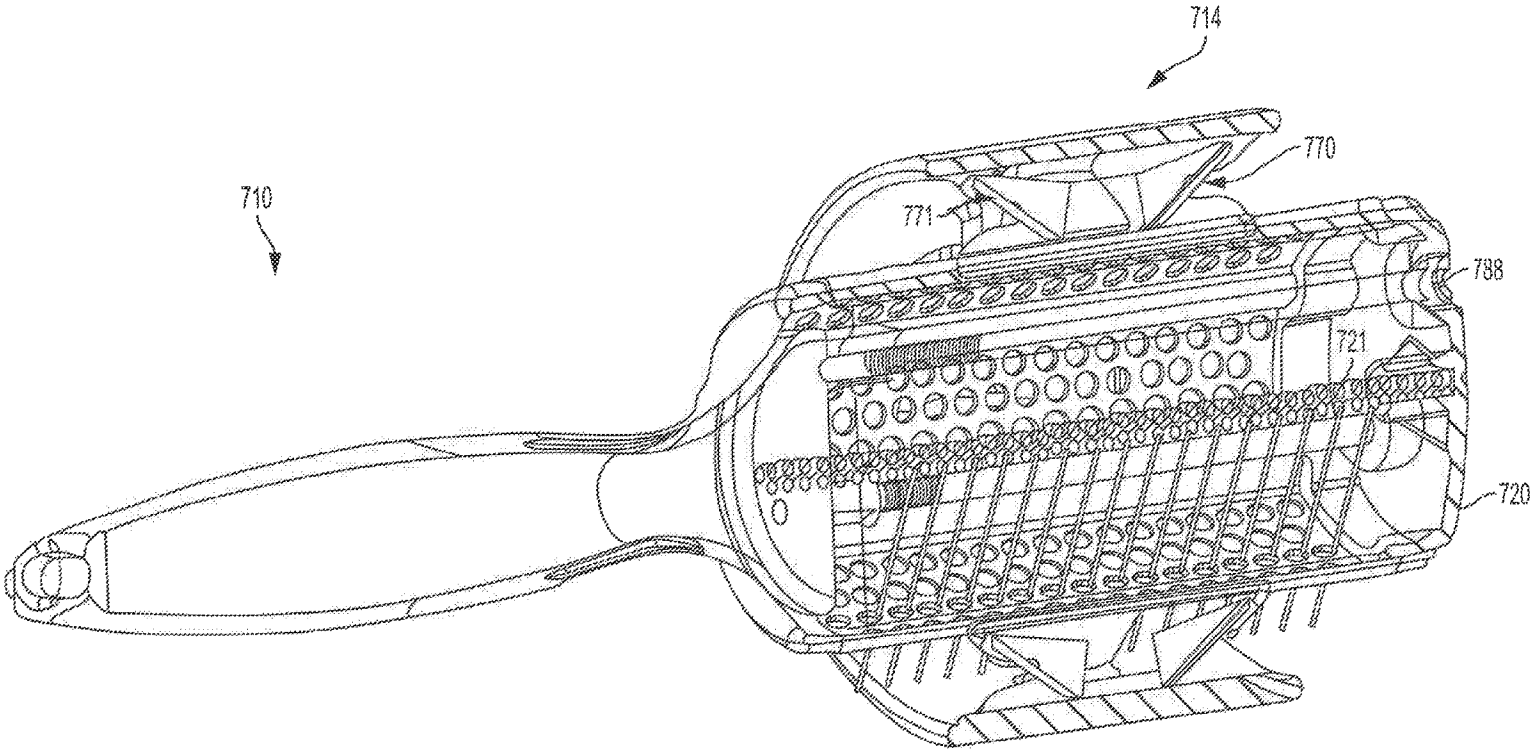
FIG. 7C illustrates a cross-section of a perspective view of the system of FIG. 7B.

Referring to FIGS. 7A-7C, examples of aspects of a system 700 of the present disclosure are shown. FIG. 7A shows a perspective view of system 700, FIG. 7B shows another perspective view of system 700, and FIG. 7C shows a cross-section of a perspective view of system 700. System 700 includes a brush 710 and a cleaner device 714. System 700 may include or correspond to system 100 or the system 500 as described herein. For example, brush 710 may include or correspond to brush 110, 510, and cleaner device 714 may include or correspond to cleaner device 114, 514.

Figure 8A:
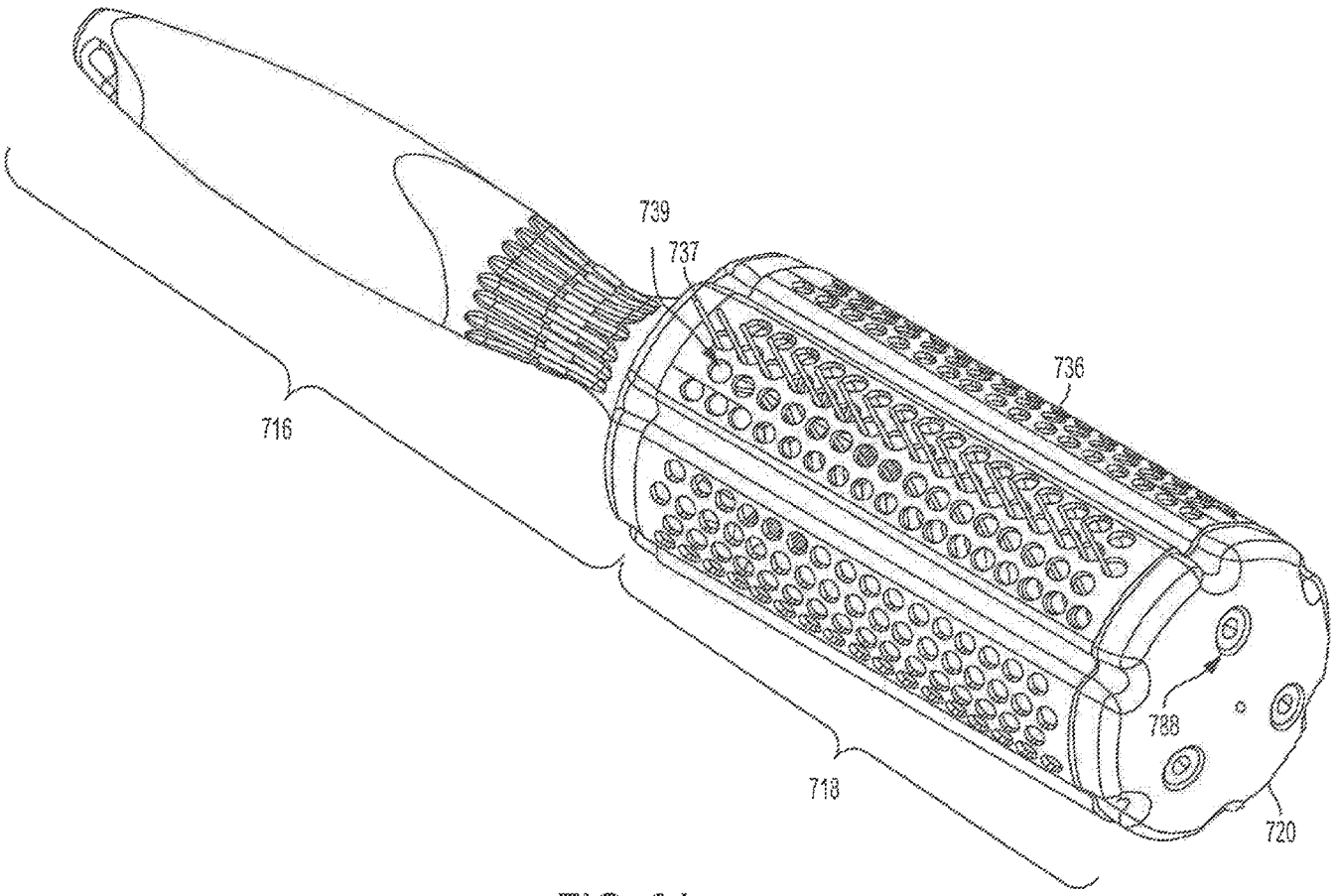
FIG. 8A illustrates a perspective view of the brush of FIG. 7A.
Figure 8B:
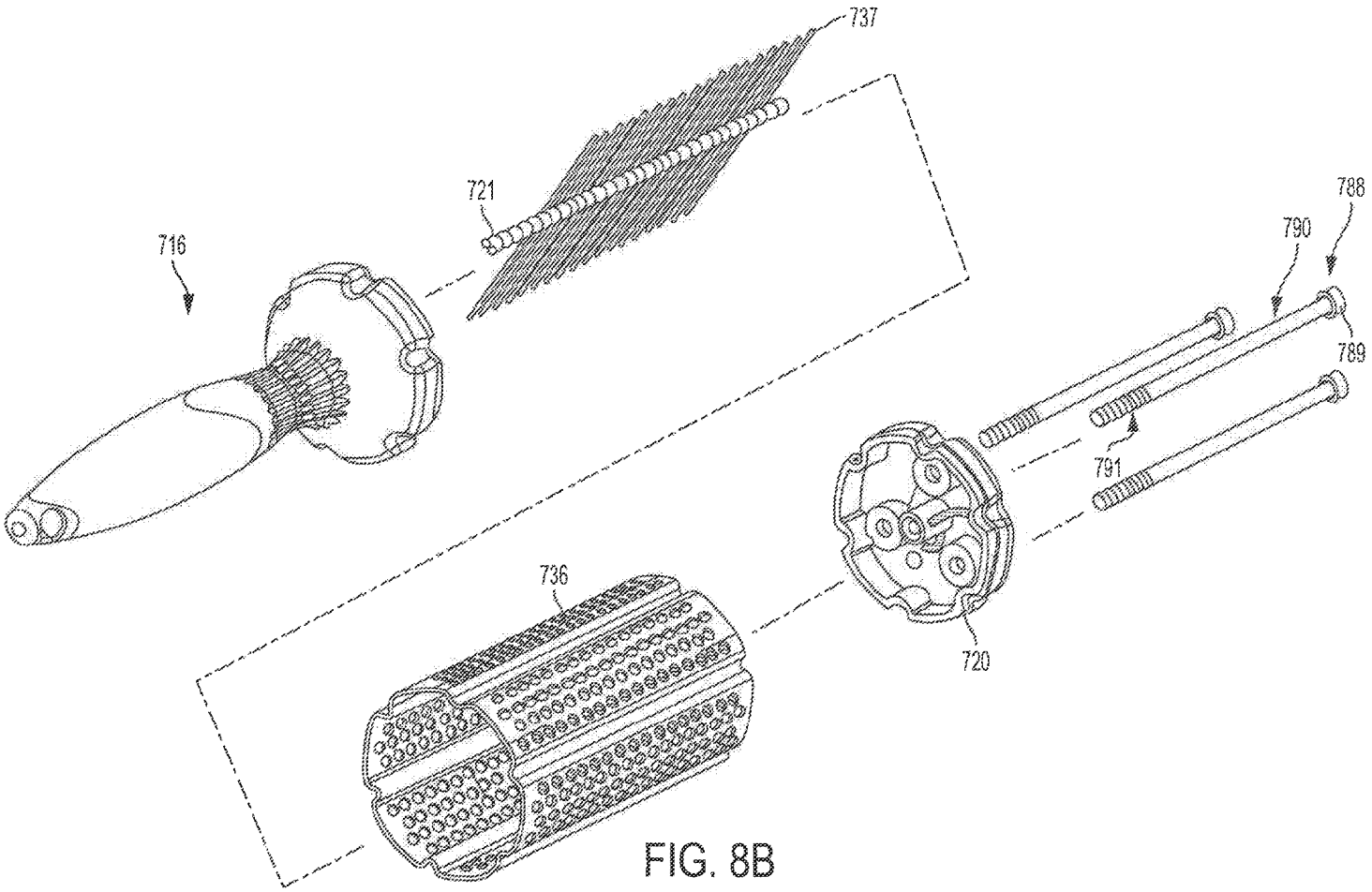
FIG. 8B illustrates a first exploded view of the brush of FIG. 7A.
Figure 8C:
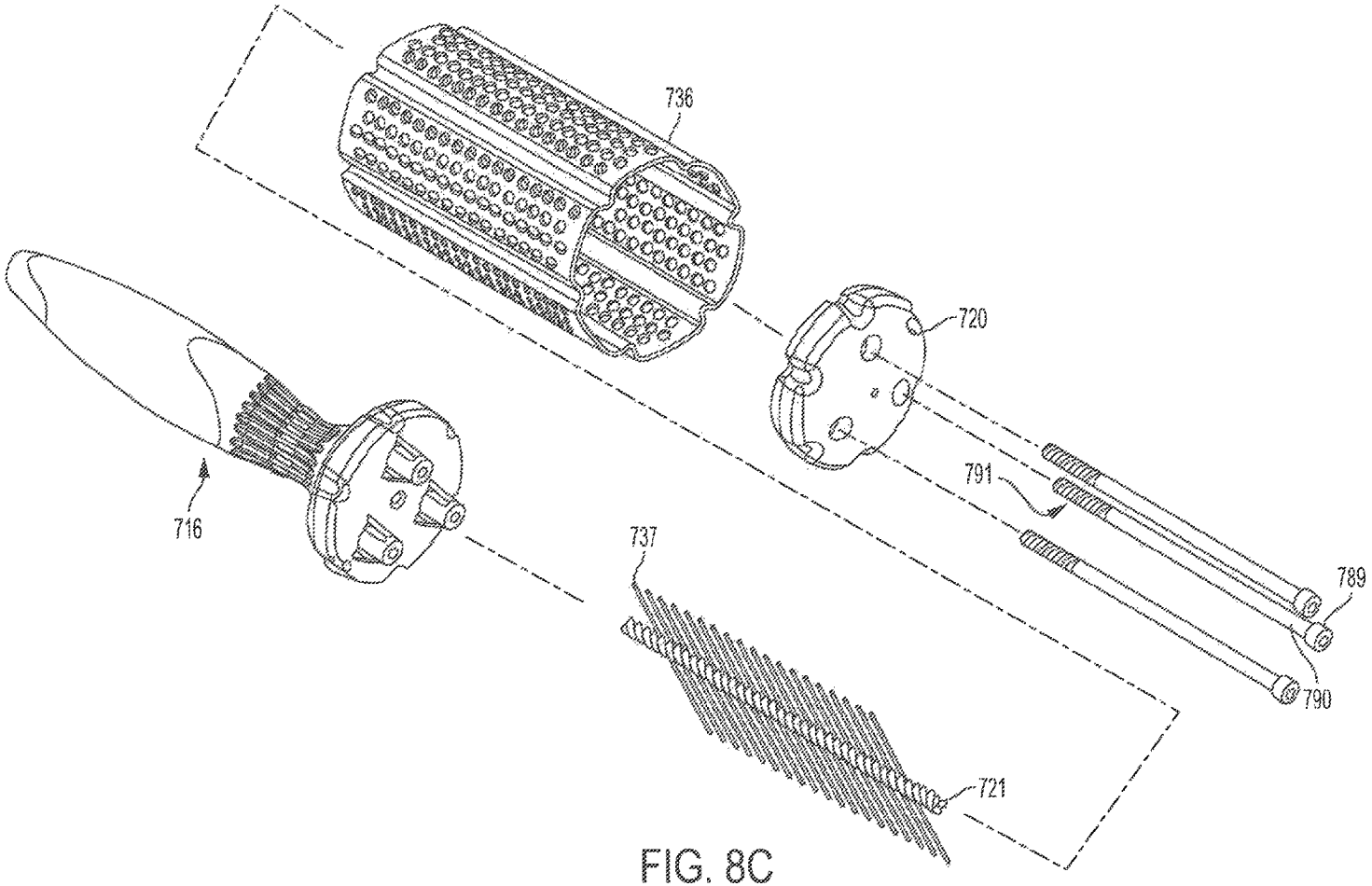
FIG. 8C illustrates a second exploded view of the brush of FIG. 7A.
Figure 8F:
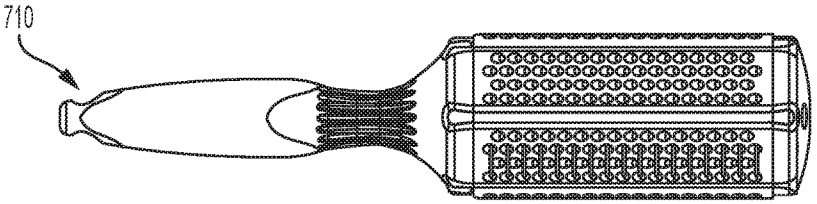
FIG. 8F illustrates a side view of the brush of FIG. 7A.
Figure 8G:
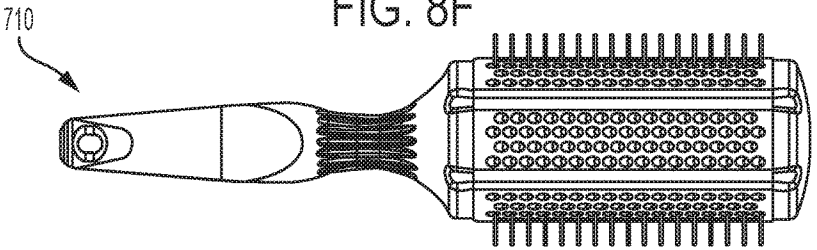
FIG. 8G illustrates a side view of the brush of FIG. 7A.
Figure 8H:
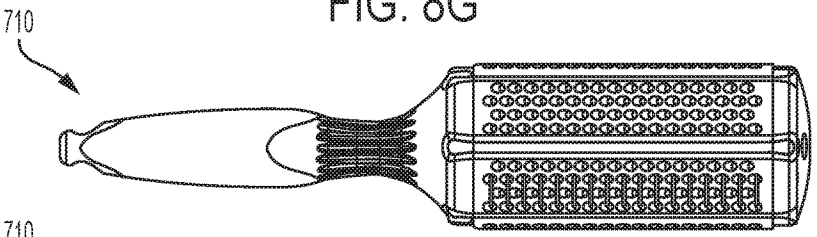
FIG. 8H illustrates a side view of the brush of FIG. 7A.
Figure 8I:
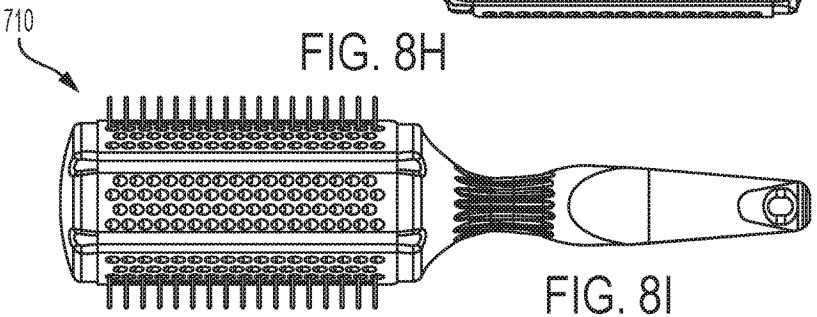
FIG. 8I illustrates another side view of the brush of FIG. 7A.
Figure 8D:
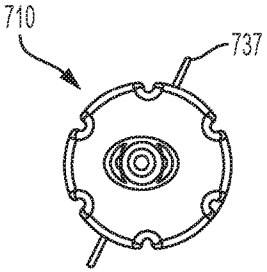
FIG. 8D illustrates a bottom view of the brush of FIG. 7A.
Figure 8E:
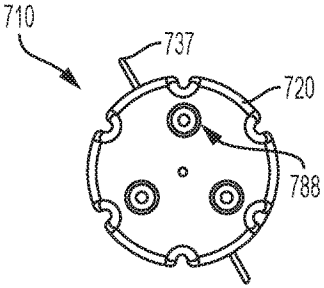
FIG. 8E illustrates a top view of the brush of FIG. 7A.

As shown in FIGS. 7A-7C, brush 710 includes a handle portion 716, a bristle portion 718, a cap 720, a coupler 721, and one or more screw, such as a representative screw 788. Additional examples of brush 710 are described herein at least with reference to FIGS. 8A-8I. Referring to FIGS. 8A-8I, illustrative examples of aspects of brush 710 are shown. FIG. 8A shows an exploded view of brush 710, FIG. 8B shows an end view of brush 710, FIG. 8C shows another end view of brush 710, FIG. 8D shows a side view of brush 710, FIG. 8E shows another side view of brush 710, FIG. 8F shows a top view of brush 710, FIG. 80 shows a bottom view of brush 710, and FIG. 8H shows a cross-section of a perspective view of brush 710, and FIG. 8I shows another cross-section of a perspective view of brush 710.

Referring to FIGS. 7A-7C and FIGS. 8A-8I, brush 710 further includes a first end 726 and a second end 728 that is opposite the first end 726. As shown, first end 726 corresponds to handle portion 716 and second end 728 corresponds to cap 720. A longitudinal axis of brush 710 extends from first end 726 to second end 728. Brush 710 has a length L5 from first end 726 to second end 728 along the longitudinal axis of brush 710.

Coupler 721 is positioned within (e.g., extends through) bristle portion and is configured to be coupled to handle portion 716 and cap 720 (e.g., an end cap). For example, coupler 721 includes a first end coupled to handle portion 716 and a second end coupled to cap 720, such that bristle portion 718 is positioned intermediate handle portion 716 and the cap 720.

The one or more screws (e.g., 788) are coupled to handle portion 716 and cap 720. Each of the screws may be configured to secure bristle portion 718 between handle portion 716 and cap 720. The one or more screws (e.g., 788) may include one or more metal screws, one or more plastic screws, or a combination thereof. Screw 788 includes a screw head 789, a shaft 790, and threads 791. As shown, screw 788 is inserted through cap 720 and bristle portion 718, and threads 791 are coupled to corresponding threads of handle portion 716. In other implementations, brush 710 may be configured such that screw 788 is inserted through handle portion 716 and bristle portion 718, and threads are coupled to corresponding threads of cap 720. Although described as having one or more screws (e.g., 788), in other implementations, brush 710 may alternatively (or in addition to) include one or more fasteners other than a screw that are coupled handle portion 716 to cap 720 or that securely couple bristle portion 718 between handle portion 716 and cap 720. To illustrate, brush 710 may include a fastener, such as a bolt, a spring, a tab, a clip, a magnet, or a combination thereof, as illustrative, non-limiting examples.

Handle portion 716, bristle portion 718, cap 720, and coupler 721 may include or correspond to handle portion 116, 516, bristle portion 118, 5118, cap 120, 520, and coupler 121, 521, respectively. For example, handle portion 716 may include one or more features (e.g., ridges 131) as described with reference to handle portion 116. Handle portion 716 is coupled to bristle portion 718 at an interface 722 and bristle portion 718 is coupled to cap 720 at an interface 724.

Bristle portion 718 includes a body 736 and a plurality of bristles, such as a representative bristle 737. It is noted that fewer than all of the plurality of bristles have been shown for ease of illustration. Body 736 includes a surface 738 having a plurality of openings, such as a representative opening 739, defined therein. The plurality of bristles may be coupled to the coupler 721 at least a portion of each bristle (e.g., 737) of the plurality of bristles extends from or through surface 738 of body 736 (e.g., bristle portion 718). The plurality of bristles (e.g., 737) and/or the plurality of openings (e.g., 739) may be arranged in a one or more rows, in a pattern, randomly, or a combination thereof. Accordingly, it is noted that the arrangement shown is not intended to limiting and other arrangements are possible.

Body 736 includes one or more channels, such as a representative channel 740. Body 736, surface 738, opening 739, and channel 740 may include or correspond to body 136, 536, surface 138, 536, opening 139, 539, and channel 140, 540. Body 736 may have a diameter D5 (e.g., a barrel diameter) in a plane that is perpendicular to the longitudinal axis of brush 710. A diameter D6 (e.g., a bristle diameter) in a plane that is perpendicular to the longitudinal axis of brush 710 may correspond to a distance from a bristle tip of a first bristle (e.g., 737) to another bristle tip of a second bristle that is opposite the first bristle. For example, diameter D5 and diameter D6 may include or correspond to diameter D1, D3 and diameter D2, D4, respectively.

Figure 9A:
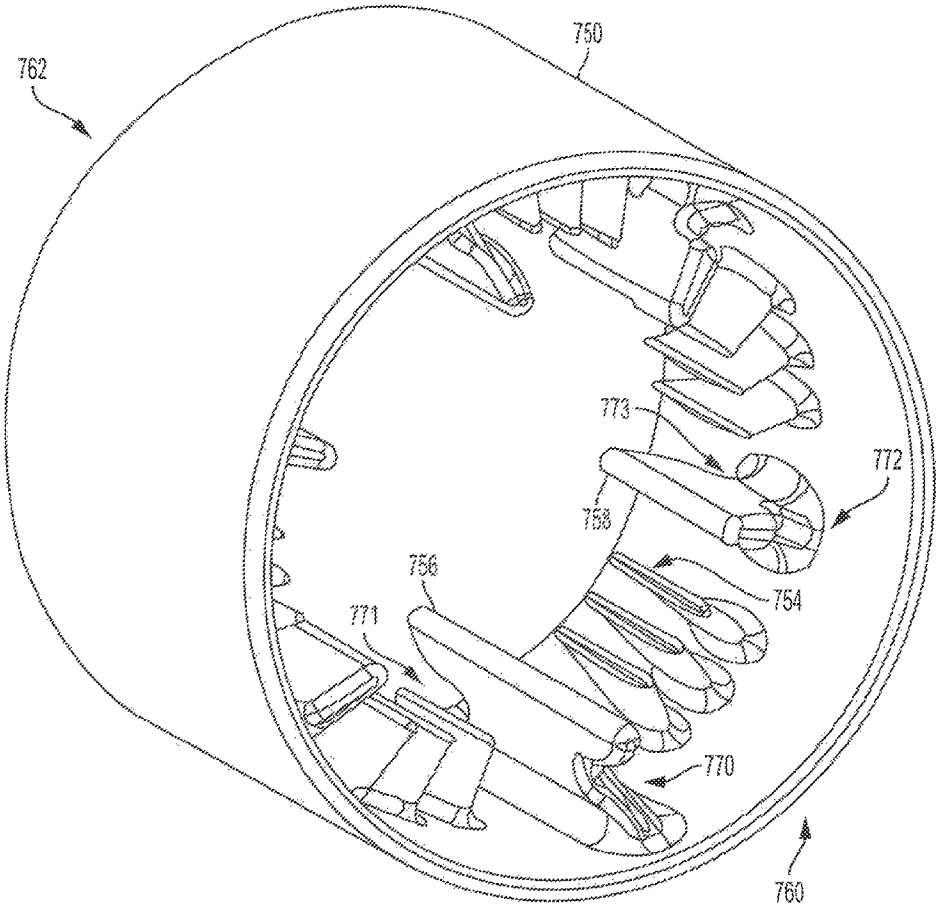
FIG. 9A illustrates a front perspective view of the cleaner device of FIG. 7A.
Figure 9C:
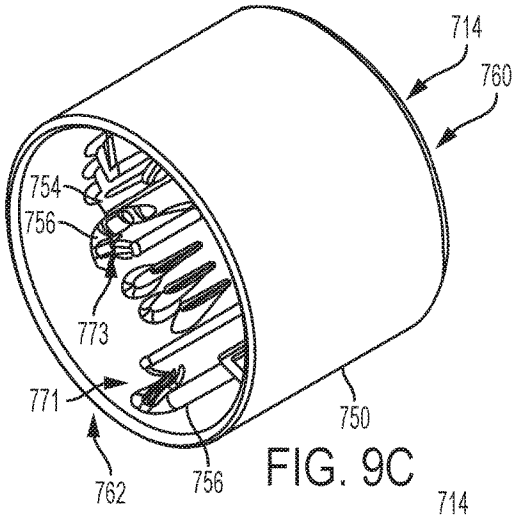
FIG. 9C illustrates a rear perspective view of the example of the cleaner device of FIG. 7A.
Figure 9B:
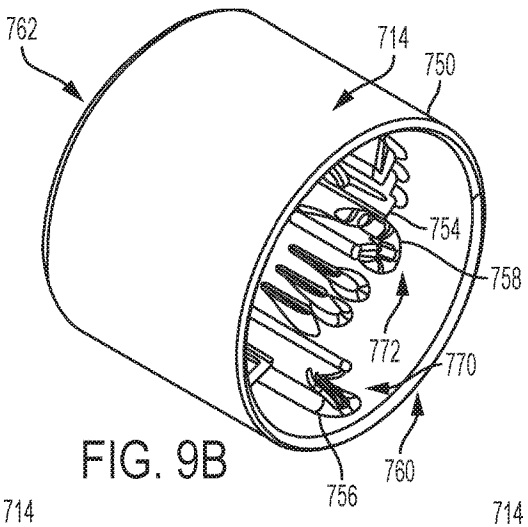
FIG. 9B illustrates another front perspective view of the cleaner device of FIG. 7A.
Figure 9F:
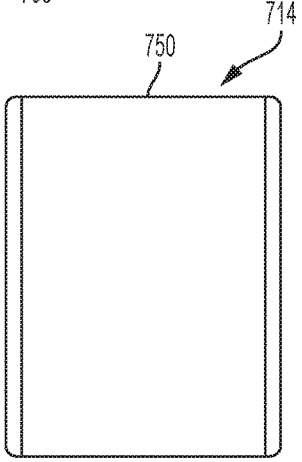
FIG. 9F illustrates a side view of the example of the cleaner device of FIG. 7A.
Figure 9E:
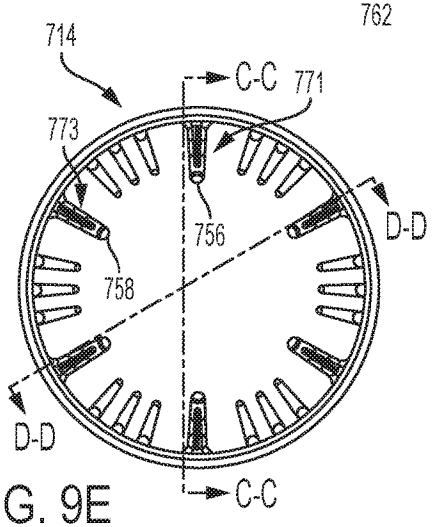
FIG. 9E illustrates a rear view of the example of the cleaner device of FIG. 7A.
Figure 9D:
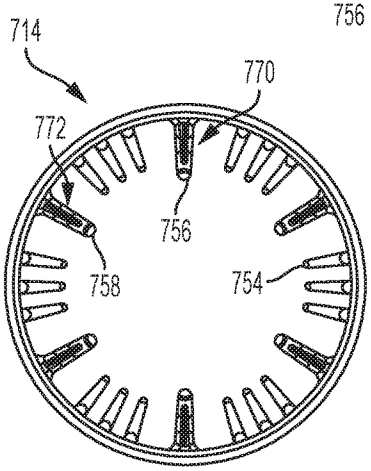
FIG. 9D illustrates a front view of the example of the cleaner device of FIG. 7A.
Figure 9H:
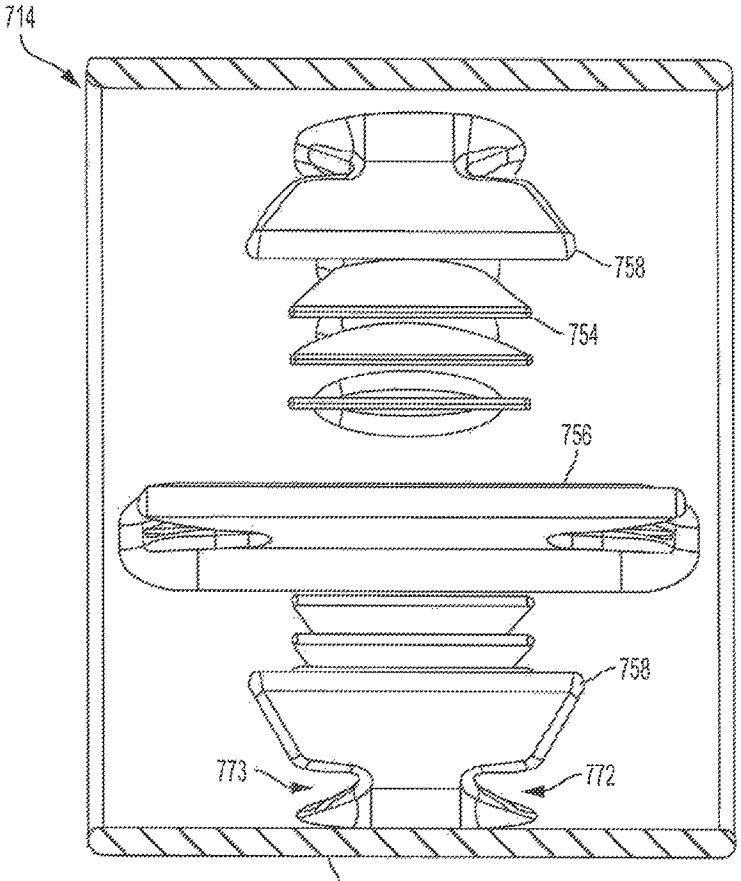
FIG. 9H illustrates a cross-sectional view of the cleaner device of FIG. 7A along D-D of FIG. 9E.
Figure 9G:
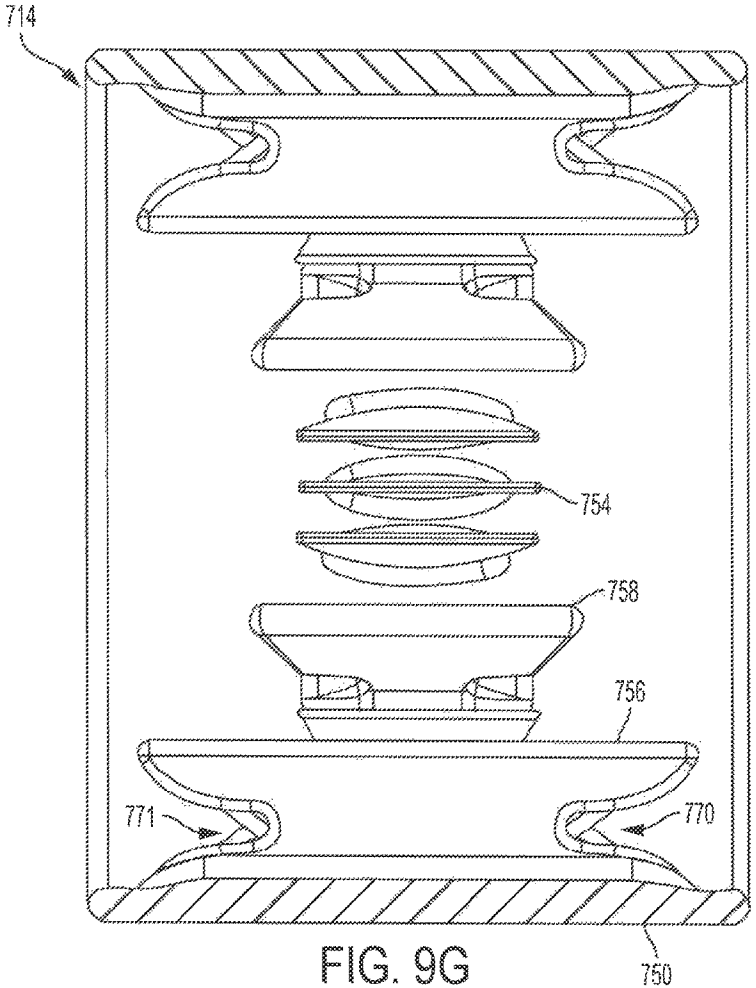
FIG. 9G illustrates a cross-sectional view of the cleaner device of FIG. 7A along C-C of FIG. 9E.

Cleaner device 714 is configured to remove hair from plurality of bristles of brush 710. Additional, examples of cleaner device 5714 are described herein, at least with reference to FIGS. 9A-9H. Referring to FIGS. 9A-9H examples of aspects of a cleaner device 714 are shown. FIG. 9A shows a front perspective view of cleaner device 714, FIG. 9B shows another front perspective view of cleaner device 714, FIG. 9C shows a rear perspective view of cleaner device 714, FIG. 9D shows a front view of cleaner device 714, FIG. 9E shows a rear view of cleaner device 714, FIG. 9F shows a side view of cleaner device 714, FIG. 9G shows a cross-sectional view of cleaner device 714, and FIG. 9H shows another cross-sectional view of cleaner device 714.

Referring to FIGS. 7A-7C and 9A-9H, cleaner device 714 includes frame 750, one or more protrusions 754, and one or more flanges, such as a representative first flange 756 and a representative second flange 758. Frame 750 may include or correspond to frame 150, 550; protrusions 754 may include or correspond to protrusions 154, 554; and flanges 756, 758 may include or correspond to flanges 156, 158 or flanges 556, 558. For example, flange 756 includes a cutter 770 (e.g., a cutter 170, 570) configured to cut hair entangled in the plurality of bristles. Cutter 770 includes one or more edges, such as one or more blades, or cutter 770 is shaped/formed to have a sharp edge. As shown, protrusions 754 include a cleaner fin (e.g., a cleaner flange).

A longitudinal axis of cleaner device 714 extends from a first end 760 (of frame 750) to a second end 762 that is opposite the first end 760. Cleaner device 714 has a length L6 from first end 760 to second end 5762 along the longitudinal axis of cleaner device 714. Length L6 may be large enough to provide a user to hold cleaner device 714 and to keep the user's hand free from contact with brush 710 as cleaner device 714 is operated to clean brush 710. In some implementations, length L6 may be equal to an end-to-end length (from interface 722 to interface 724) of bristle portion 718. Alternatively, length L6 may be greater than or less than the end-to-end length of bristle portion 718. As compared to the cleaner device 114 (as shown) of system 100, cleaner device 714 of system 700 is larger in relation to bristle portion 718. However, it is noted that a size of cleaner device 114 and/or a size of cleaner device 714 is not intended to be limited or restricted.

Cleaner device 714 is configured to be used to clean a corresponding brush (e.g., brush 110, 510) by passing the brush through cleaner device 714 via either first end 760 or second end 762. To illustrate, each of the one or more protrusions 754 and the one or more flanges (e.g., 756, 758) are configured to operate in two directions. First flange 756 includes a first cutter 770 having one or more edges that face first end 760 and includes a second cutter 771 having one or more edges that face second end 762. The cutter(s) 170 may include one or more blades or may be formed by an edge of a flange structure, as illustrative, non-limiting example. As shown in FIG. 3F, flange 156 includes two blades having a "V" configuration. In some implementations, cutter 170 may be incorporated into or offset from a hair lift feature of a flange that includes the cutter. For example, as shown in FIG. 3F, one of the two blades may be configured to lift (e.g., guide) hair along the blade and towards the other blade. Second flange 758 includes a first groove 772 that faces first end 760 and includes a second groove 773 that faces second end 762. As shown in FIG. 3G, flange 158 includes a hair lift feature that lifts (e.g., guides) hair to groove 172, also referred to herein as a reservoir (e.g., a hair collection reservoir). Protrusions 754 are configured to remove hair from bristles using a first hair contact edge that faces first end 760 or using a second hair contact edge that faces second end 762. Thus, cleaner device 714 includes a simplified user operational design in which cleaner device 714 may be used to clean a brush without having to identify or ensure that a direction of travel of the cleaner device is correct.

As shown, cleaner device 714 includes two flanges 756 having cutters 770 and four flanges 758 having grooves 772. In other implementations, a cleaner device 714 may include a single flange 756 having a cutter or more than two flanges 756 having cutters, may include fewer than four flanges 758 having grooves (e.g., a single flange 758) or more than four flanges 758 having grooves, or a combination thereof. In some implementations, cleaner device 714 may include fewer or more protrusions 754 than shown. Additionally, or alternatively, one or more of flange 756, flange 758, or a protrusion (e.g., 754) may include a rubber end to promote cleaning and removal of material and/or hair product coupled to surface 738 and/or within channels (e.g., 740).

One advantage provided by the system 700 (e.g., brush 710 and/or cleaner device 714) includes enabling efficient cleaning a brush (e.g., removing hair from the brush). For example, system 700 may clean (e.g., remove hair from) the brush in a single pass. Additionally, cleaner device 714 is configured to be used in more than one direction to clean brush 710 such that cleaner device 714 may be used to clean a brush without having to identify or ensure that a direction of travel of the cleaner device is correct. Another benefit of cleaner device 714 is that cleaner device 714 promotes hair removal from brush 710 during operation of the cleaner device 714 even when brush 710 has accumulated a relatively large amount of hair. To illustrate, during operation of cleaner device 714, cleaner device 714 may lift the hair away from surface 738 of brush 710 and away from the bristles of brush 710. Additionally, during operation of cleaner device 714, cleaner device 714 may cut one or more hairs during cleaning to make the hair easier to remove. Thus, system 700 enables safe, convenient, simple, and efficient techniques for cleaning a brush as compared to conventional approaches.

Figure 10:
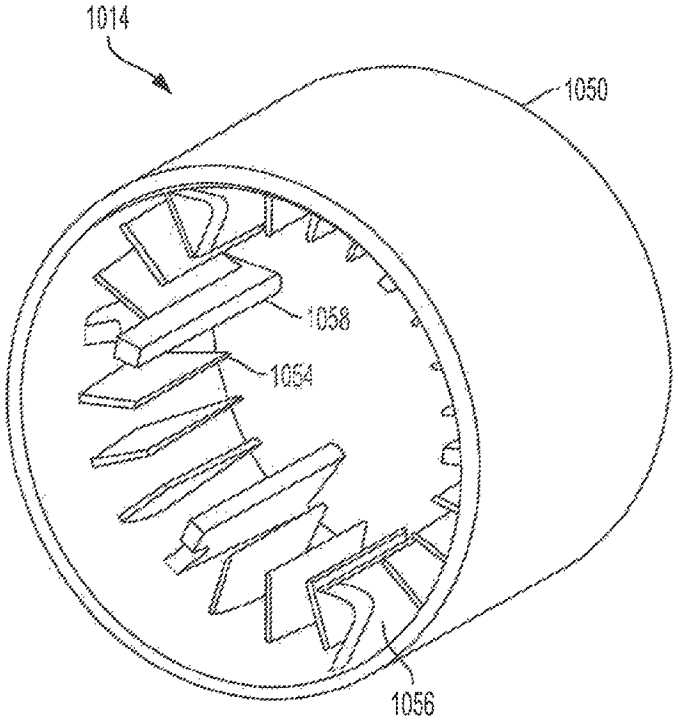
FIG. 10 illustrates a front perspective view of another example of a cleaner device.

Referring to FIG. 10, a front perspective view of aspects of an example of a cleaner device 1014 is shown. Cleaner device 1014 may include or correspond to cleaner device 114, cleaner device 514, or cleaner device 714. Cleaner device 1014 includes frame 1050, one or more protrusions 1054, and one or more flanges, such as a representative first flange 1056 and a representative second flange 1058. Frame 1050 may include or correspond to frame 150, frame 550, or frame 750. Protrusions 1054 may include or correspond to protrusions 154, protrusions 554, or protrusions 754. Flanges 1056, 1058 may include or correspond to flanges 156, 158, flanges 556, 558, or flanges 756, 758.

As shown, flange 1056 does not include a blade (e.g., a razor); rather, flange 1056 is shaped to have an edge that is configured to cut or break hair. The protrusions 1054 include a cleaner flange (e.g., a fin) that is configured to have a larger contact surface area with an inner surface of cleaner device 1014 as compared to protrusions 154 as shown in at least FIG. 1A. Additionally, as shown, flange 1058 includes a surface in a direction of travel that is flat. In implementations where flange 1058 is configured to be inserted in a channel of a brush, the surface of flange 1058 may fill a cross section of the channel and push material/hair product to advantageously remove the material/hair product from the channel.

Figure 11:
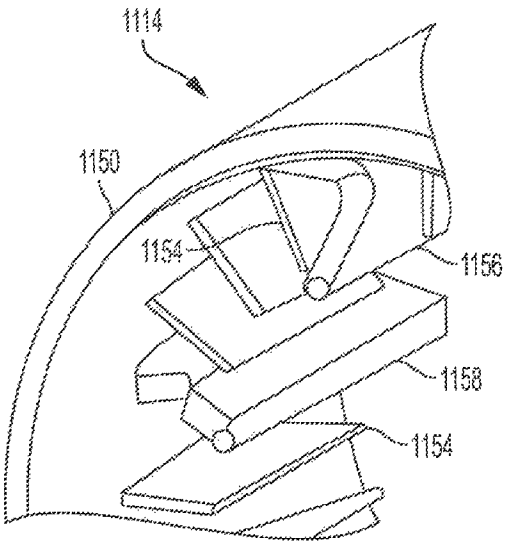
FIG. 11 illustrates an enlarged perspective view of a portion of another example of a cleaner device.

Referring to FIG. 11, an enlarged perspective view of a portion of an example of a cleaner device 1114 is shown. Cleaner device 1114 may include or correspond to cleaner devices 114, 514, 714, 1014. Cleaner device 1114 includes frame 1150, one or more protrusions 1054, and one or more flanges, such as a representative first flange 1156 and a representative second flange 1158. Frame 1150 may include or correspond to frame 150, 550, 750, 1050; protrusions 1154 may include or correspond to protrusions 154, 554, 754, 1054; and flanges 1156, 1158 may include or correspond to flanges 156, 158, flanges 556, 558, flanges 756, 758, or flanges 1056, 1058. As shown, as shown, flange 1158 includes a surface in a direction of travel that includes a hook (e.g., a nub). In implementations where flange 1158 is configured to be inserted in a channel of a brush, the hook of flange 1158 may advantageously dislodge (e.g. pry up) push material/hair product or hair in contact with a bottom surface of the channel for removal of the material/hair product and/or the hair.

Figure 12A:
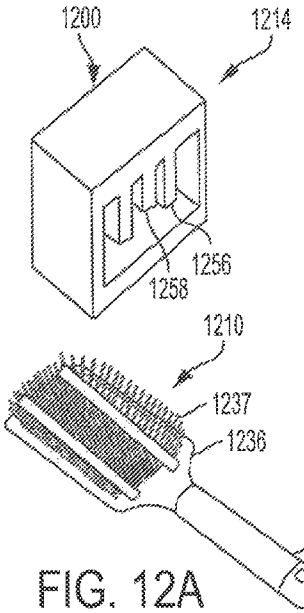
FIG. 12A illustrates a perspective view of another example of a system for cleaning a brush.
Figure 12C:
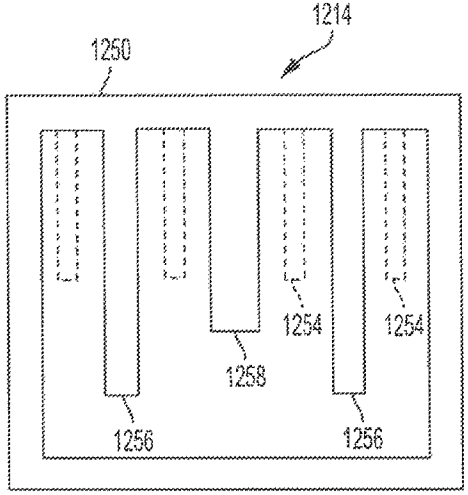
FIG. 12C illustrates a front view of an example of a cleaner device of the system of FIG. 12A.
Figure 12B:
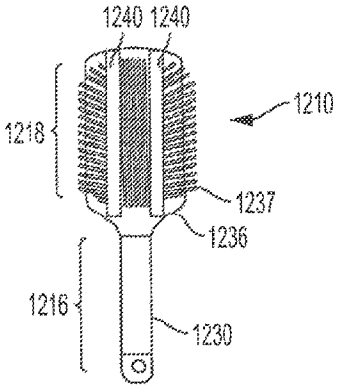
FIG. 12B illustrates a top view of an example of the brush of FIG. 12A.
Figure 12D:
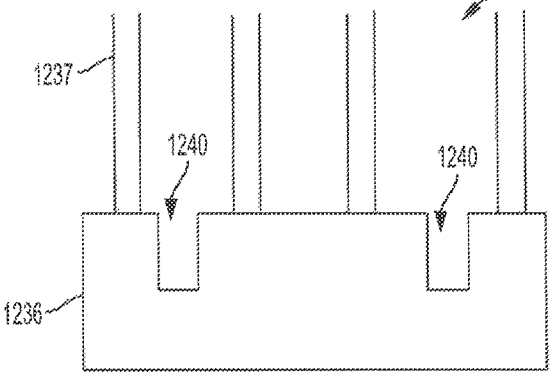
FIG. 12D illustrates an end view of the example of the brush of FIG. 12A.

Referring to FIGS. 12A-12D, examples of aspects of a system 1200 are shown. System 1200 includes a brush 1210 and a cleaner device 1214. FIG. 12A shows a perspective view of system 1200, FIG. 12B shows a top view of brush 1210, FIG. 12C shows a front view of cleaner device 1214 of system 1200, and FIG. 12D shows an end view of brush 1210. It is noted that cleaner device 1214 and end view of brush 1210 are depict as a simplified block-type structures where one or more detailed features/aspects have been omitted for ease of illustration.

As shown in FIGS. 12A-12D, brush 1210 includes a handle portion 1216 and a bristle portion 1218. Handle portion 1216 is coupled to bristle portion 1218. Handle portion 1216 includes a handle 1230. Bristle portion 1218 includes a body 1236 and a plurality of bristles, such as a representative bristle 1237. Body 1236 includes a flat shape (e.g., a rectangular block shape). Body 1236 includes one or more channels, such as a representative channel 1240. In some implementations, body 1236 may include bristles on two different surfaces, such as two opposite surfaces (e.g., a top surface and a bottom surface) of body 1236. In such implementations, one or both of the surfaces may include channels or have channels formed therein Cleaner device 1214 is configured to remove hair from plurality of bristles of brush 1210. Cleaner device 1214 may include or correspond to cleaner devices 114, 514, 714, 1014, 1114. Cleaner device 1214 includes frame 1250, one or more protrusions 1254 (not represented in FIG. 12A and represented as dashed lines in FIG. 12B for ease of illustration), and one or more flanges, such as a representative first flange 1256 and a representative second flange 1258. Frame 1250 may include or correspond to frame 150, 550, 750, 1050, 1150; protrusions 1254 may include or correspond to protrusions 154, 554, 754, 1054, 1154; and flanges 1256, 1258 may include or correspond to flanges 156, 158, flanges 556, 558, flanges 756, 758, flanges 1056, 1058, or flanges 1156, 1158. In some implementations, one or more of flanges 1256, 1258, or protrusions 1254 may be recessed (e.g., offset) with respect to a first end surface and/or a second end surface of cleaner device. In implementations where body 1236 may include bristles on two different surfaces, such as two opposite surfaces (e.g., a top surface and a bottom surface) of body 1236, cleaner device 1214 may include additional flanges 1256, 1258 and/or additional protrusions 1254 to clean both sides of the brush 1210.

As shown, cleaner device 1214 (e.g., frame 1250) has a ring shape that is non-circular. As shown, frame 1250 is generally block shaped. However, frame 1250 having a block shape is for illustration only and other non-circular ring shapes may be implemented. For example, shape of cleaner device 1214 (e.g., frame 1250) may be selected based on a shape of one or more brushes, ergonomic considerations, or a combination thereof. Accordingly, system 1200 may advantageously be configured to clean a brush that has a bristle portion with a configuration other than a barrel configuration (e.g., a barrel shape).

Figure 13B:
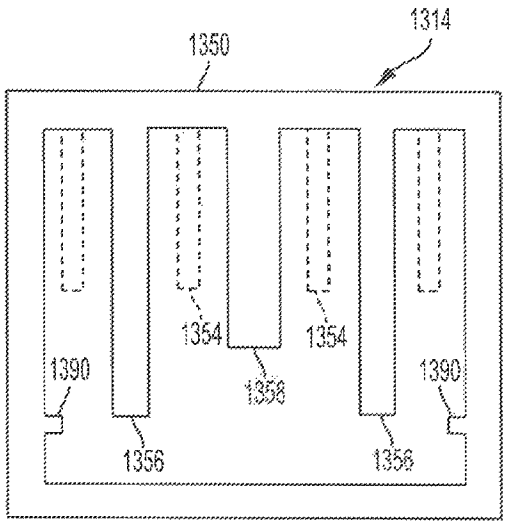
FIG. 13B illustrates a front view of an example of a cleaner device of the system of FIG. 13A.
Figure 13C:
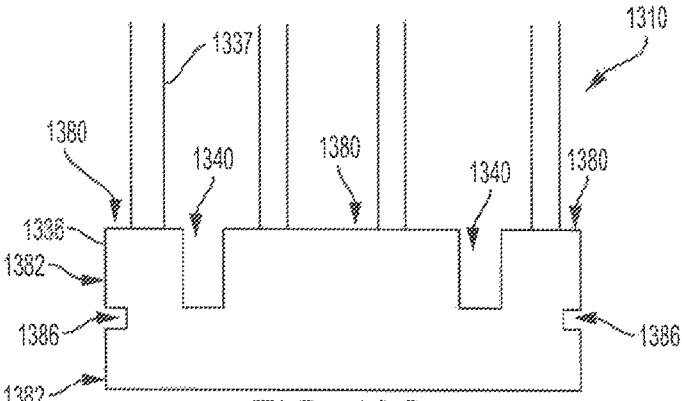
FIG. 13C illustrates an end view of the example of the brush of FIG. 13A.
Figure 13A:
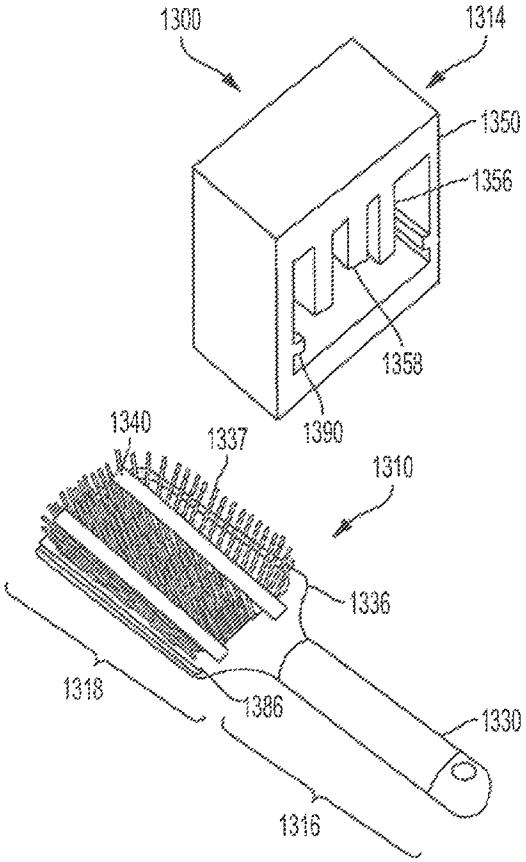
FIG. 13A illustrates a perspective view of another example of a system for cleaning a brush.

Referring to FIGS. 13A-13C, examples of aspects of a system 1300 are shown. System 1300 includes a brush 1310 and a cleaner device 1314. FIG. 13A shows a perspective view of system 1300, FIG. 13B shows a front view of cleaner device 1314, and FIG. 13C shows an end view of brush 1310. It is noted that cleaner device 1314 and end view of brush 1310 are depict as a simplified block-type structures where one or more detailed features/aspects have been omitted for ease of illustration.

As shown in FIGS. 13A-13C, brush 1310 includes a handle portion 1316 and a bristle portion 1318. Handle portion 1316 is coupled to bristle portion 1318. Handle portion 1316 includes a handle 1330. Bristle portion 1318 includes a body 1336 and a plurality of bristles, such as a representative bristle 1337. Body 1336 includes a flat shape (e.g., a rectangular oval block shape). Body 1336 includes one or more first channels, such as a representative first channel 1340, on or formed in a first surface 1380, and one or more second channels formed on at least one second surface, such as representative second surface 1382 that is distinct from first surface 1380. The one or more second channel may include a representative second channel 1386.

Cleaner device 1314 is configured to remove hair from plurality of bristles of brush 1310. Cleaner device 1314 may include or correspond to cleaner devices 114, 514, 714, 1014, 1114, 1214. Cleaner device 1314 includes frame 1350, one or more protrusions 1354 (not represented in FIG. 13A and represented as dashed lines in FIG. 13B for ease of illustration), and one or more flanges, such as a representative first flange 1356 and a representative second flange 1358. Frame 1350 may include or correspond to frame 150, 550, 750, 1050, 1150, 1250; protrusions 1354 may include or correspond to protrusions 154, 554, 754, 1054, 1154, 1254; and flanges 1356, 1358 may include or correspond to flanges 156, 158, flanges 556, 558, flanges 756, 758, flanges 1056, 1058, flanges 1156, 1158, or flanges 1256, 1258. As shown, cleaner device 1314 (e.g., frame 1350) includes additional flanges 1390, such as guides (e.g., guide projections). The additional flanges 1390 may be configured to be inserted into and travel along the one or more second channels. In some implementations, one or more of flanges 1356, 1358, 1390, or protrusions 1354 may be recessed (e.g., offset) with respect to a first end surface and/or a second end surface of cleaner device.

Accordingly, system 1300 may advantageously be configured to clean a brush that has a bristle portion with a configuration other than a barrel configuration (e.g., a barrel shape). Additionally, the channels 1386 and the flanges 1390 may interact to improve alignment, stability, and a path of travel of brush 1310 through cleaner device 1314 as compared to other systems that do not include channels and flanges similar or analogous to the channels 1386 and the flanges 1390.

Figure 14B:
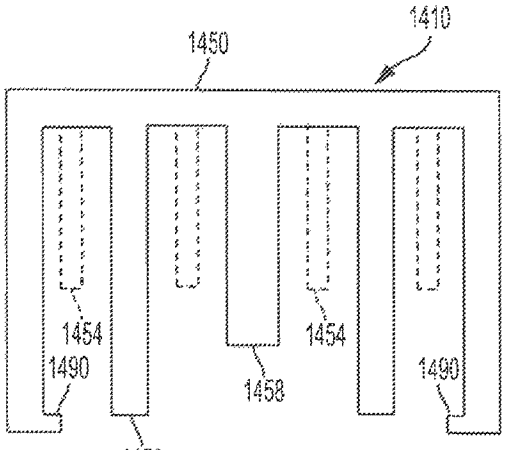
FIG. 14B illustrates a front view of an example of a cleaner device of the system of FIG. 14A.
Figure 14C:
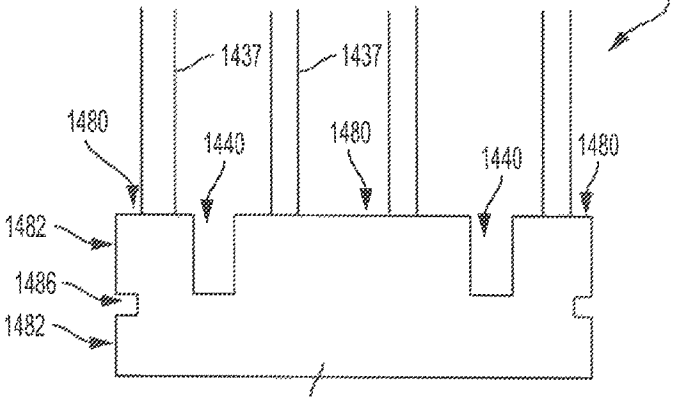
FIG. 14C illustrates an end view of the example of the brush of FIG. 14A.
Figure 14A:
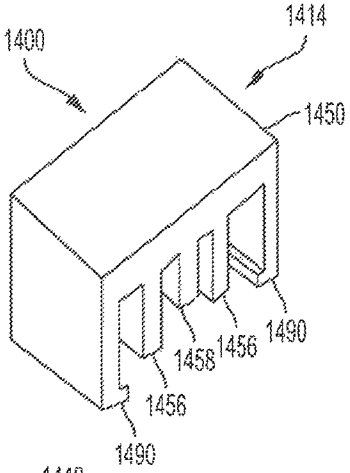
FIG. 14A illustrates a perspective view of another example of a system for cleaning a brush.
Figure 14A:
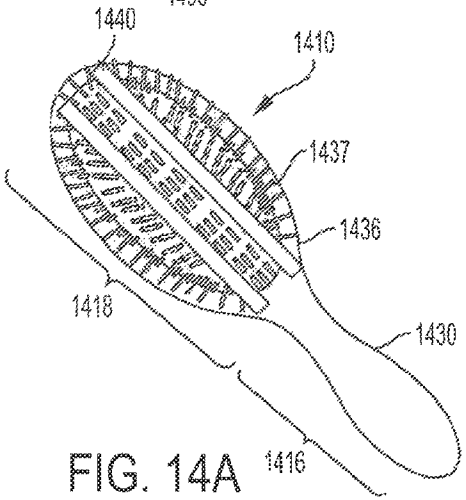

Referring to FIGS. 14A-14C, examples of aspects of a system 1400 are shown. System 1400 includes a brush 1410 and a cleaner device 1414. FIG. 14A shows a perspective view of system 1400, FIG. 14B shows a front view of cleaner device 1414, and FIG. 14C shows an end view of brush 1410. It is noted that cleaner device 1414 and end view of brush 1410 are depict as a simplified block-type structures where one or more detailed features/aspects have been omitted for ease of illustration.

As shown in FIGS. 14A-14C, brush 1410 includes a handle portion 1416 and a bristle portion 1418. Handle portion 1416 is coupled to bristle portion 1418. Handle portion 1416 includes a handle 1430. Bristle portion 1418 includes a body 1436 and a plurality of bristles, such as a representative bristle 1437. Body 1436 includes a flat shape (e.g., an oval block shape). Body 1436 includes one or more first channels, such as a representative first channel 1440, on or formed in a first surface 1480, and one or more second channels formed on at least one second surface, such as representative second surface 1482, that is distinct from first surface 1480. The one or more second channel may include a representative second channel 1486.

Cleaner device 1414 is configured to remove hair from plurality of bristles of brush 1410. Cleaner device 1414 may include or correspond to cleaner devices 114, 514, 714, 1014, 1114, 1214, 1314. Cleaner device 1414 includes frame 1450, one or more protrusions 1454 (not represented in FIG. 14A and represented as dashed lines in FIG. 14B for ease of illustration), and one or more flanges, such as a representative first flange 1456 and a representative second flange 1458. Frame 1450 may include or correspond to frame 150, 550, 750, 1050, 1150, 1250, 1350; protrusions 1454 may include or correspond to protrusions 154, 554, 754, 1054, 1154, 1254, 1354; and flanges 1456, 1458 may include or correspond to flanges 156, 158, flanges 556, 558, flanges 756, 758, flanges 1056, 1058, flanges 1156, 1158, flanges 1256, 1258, or flanges 1356, 1358.

As shown, cleaner device 1414 (e.g., frame 1450) includes additional flanges 1490, such as guides (e.g., guide projections). For example, the additional flanges 1490 may include or correspond to the additional flanges 1390. The additional flanges 1490 may be configured to be inserted into and travel along the one or more second channels. In some implementations, one or more of flanges 1456, 1458, 1490, or protrusions 1454 may be recessed (e.g., offset) with respect to a first end surface and/or a second end surface of cleaner device. Additionally, as shown, cleaner device 1414 (e.g., frame 1450) has a U-shape that is non-circular. As shown, frame 1450 is generally block shaped. However, frame 1450 having a block shape is for illustration only and other shapes may be implemented. For example, shape of cleaner device 1414 (e.g., frame 1450) may be selected based on a shape of one or more brushes, ergonomic considerations, or a combination thereof.

Accordingly, system 1400 may advantageously be configured to clean a brush that has a bristle portion with a configuration other than a barrel configuration (e.g., a barrel shape). Additionally, the channels 1486 and the flanges 1490 may interact to improve alignment, stability, and a path of travel of brush 1410 through cleaner device 1414 as compared to other systems that do not include channels and flanges similar or analogous to the channels 1486 and the flanges 1490. Further, the U-shaped construction of frame 1450 may use less material than similar ring-shaped constructions, thus providing a cost savings of manufacturing cleaner device 1414.

Figure 15:
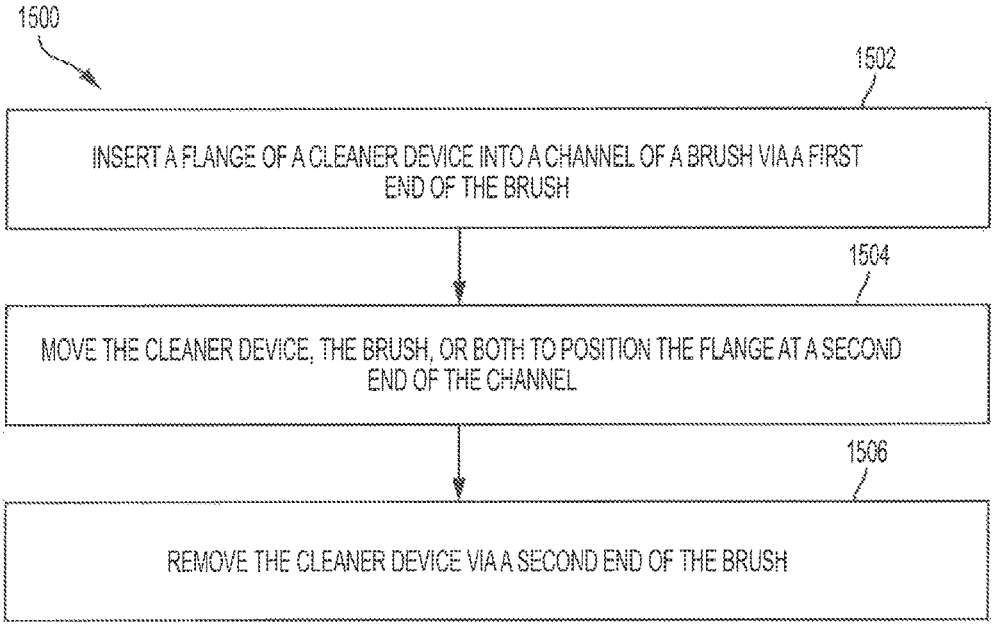
FIG. 15 illustrates a flow diagram of an example of a method of cleaning a brush.

Referring to FIG. 15, a method 1500 of cleaning a brush is shown. For example, method 1500 may be performed by system 100 (e.g., cleaner device 114), system 500 (e.g., cleaner device 514), system 700 (e.g., cleaner device 714), cleaner device 1014, cleaner device 1114, system 1200 (e.g., cleaner device 1214), system 1300 (e.g., cleaner device 1314), or system 1400 (e.g., cleaner device 1414). The brush may include or correspond to brush 110, brush 510, brush 710, brush 1210, brush 1310, or brush 1410.

The method 1500 includes inserting a flange of the cleaner device into a first end of a channel of the brush via a first end of the brush, at 1502. For example, the flange may include or correspond to flanges 156, 158, flanges 556, 558, flanges 756, 758, flanges 1056, 1058, flanges 1156, 1158, flanges 1256, 1258, or flanges 1356, 1358, 1390, flanges 1456, 1458, 1490 The channel may include or correspond to channel 140, channel 540, channel 740, channel 1240, channel 1340, 1386, channel 1440, 1486. In some implementations, the first end may correspond to a handle portion of the brush. The method 1500 also includes moving the cleaner device, the brush, or both to position the flange at a second end of the channel, at 1504. In some implementations, the second end may corresponds to a bristle portion of the brush. The method 1500 also includes removing the cleaner device via a second end of the brush, at 1506. In some implementations, the method 1500 also includes moving the cleaner device over the first end and collecting, at the cleaner device, one or more hairs from a plurality of bristles of the brush. Additionally in some such implementation, or alternatively, the method 1500 may include removing the flange from the channel and removing the one or more hairs from the brush.

Figure 16:
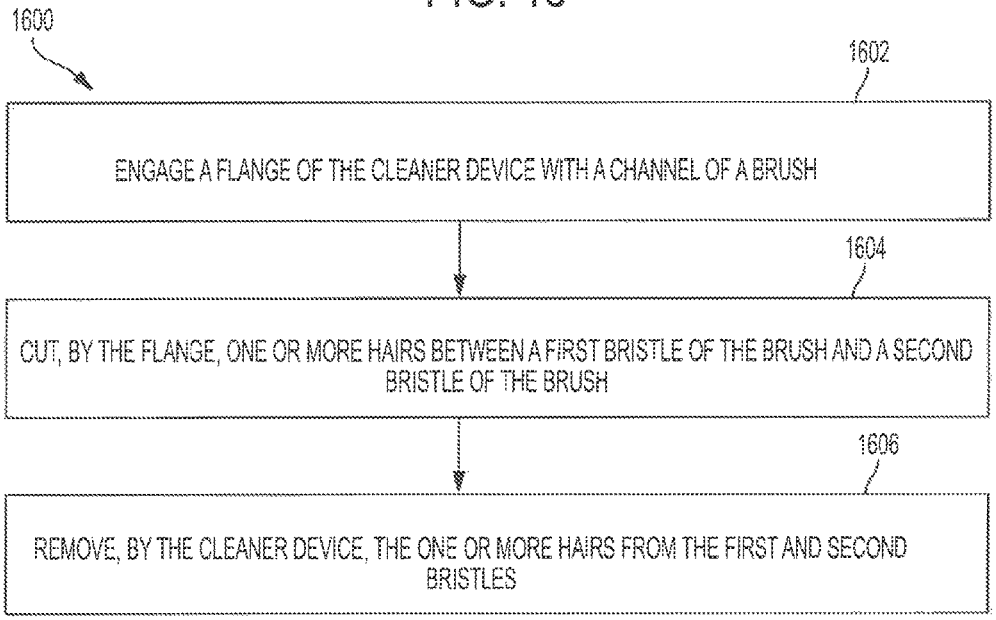
FIG. 16 illustrates a flow diagraph of an example of a method of operating a cleaner device.

Referring to FIG. 16, a method 1600 of operating a cleaner device is shown. For example, method 1600 may be performed by cleaner device 114, cleaner device 514, cleaner device 714, cleaner device 1014, cleaner device 1114, cleaner device 1214, cleaner device 1314, or cleaner device 1414. The cleaner device configured to remove hair from a plurality of bristles of a brush. The brush may include or correspond to brush 110, brush 510, brush 710, brush 1210, brush 1310, or brush 1410.

The method 1600 includes engaging a flange of the cleaner device with a channel a brush, at 1602. For example, the flange may include or correspond to flanges 156, 158, flanges 556, 558, flanges 756, 758, flanges 1056, 1058, flanges 1156, 1158, flanges 1256, 1258, or flanges 1356, 1358, 1390, flanges 1456, 1458, 1490 The channel may include or correspond to channel 140, channel 540, channel 740, channel 1240, channel 1340, 1386, channel 1440, 1486. The method 1600 also includes cutting, by the flange, one or more hairs between a first bristle of the brush and a second bristle of the brush, at 1604. The method 1600 further includes removing, by the cleaner device, the one or more hairs from the first and second bristles, at 1606. In some implementations, removing the one or more hairs may further include collecting, by one or more protrusions, another flange, or both, the one or more hairs. Additionally, or alternatively, the method 1600 may also include lifting the one or more hairs from a first position to a second position in which the one or more hairs are cut.

Thus, each of the method 1500 of FIG. 15 and the method 1600 of FIG. 16 enables cleaning a brush (e.g., removing hair from the brush). The methods 1500, 1600 can each be performed to clean (e.g., remove hair from) the brush in a single pass. Additionally, a configuration of the cleaner device promotes hair removal from the brush during operation of the cleaner device even when the brush has accumulated a relatively large amount of hair. To illustrate, during operation of the cleaner device, the cleaner device may lift the hair away from a surface of the brush and away from the bristles of the brush. Additionally, during operation of the cleaner device, the cleaner device may cut one or more hairs during cleaning to make the hair easier to remove. Thus, the methods 1500, 1600 provide safe, convenient, simple, and efficient techniques for cleaning a brush as compared to conventional approaches.

Although one or more of the disclosed figures may illustrate systems, apparatuses, methods, or a combination thereof, according to the teachings of the disclosure, the disclosure is not limited to these illustrated systems, apparatuses, methods, or a combination thereof. One or more functions or components of any of the disclosed figures as illustrated or described herein may be combined with one or more other portions of another function or component of the disclosed figures. Accordingly, no single implementation described herein should be construed as limiting and implementations of the disclosure may be suitably combined without departing from the teachings of the disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein can be utilized according to the present examples. Accordingly, the appended claims are intended to include within their scope such processes, machines, manufacture, compositions of matter, means, methods, or steps.

The invention claimed is:

1. A system for removing hair accumulated in bristles of a brush, the system comprising:

a brush comprising:

a plurality of bristles including a first set of bristles and a second set of bristles; and a channel positioned between the first and second set of bristles, the channel including a first channel opening at a first end of the channel and a second channel opening at a second end of the channel; and a cleaner assembly configured to be removably coupled to the brush, the cleaner assembly comprising:

a flange including a cutter, at least a portion of the flange configured to be inserted into the channel via the first channel opening, to travel within the channel, and to be removed from the channel via the second channel opening; and a frame coupled to the flange and configured to extend about at least a partial circumference of the brush when the portion of the flange is positioned within the channel; and where the cleaner assembly is configured to lift hair in a direction away from the brush as the portion of the flange travels within the channel.

2. The system of claim 1, where the brush further comprises:

a bristle portion having a surface, where at least a portion of each bristle of the plurality of bristles extends from or through the surface of the bristle portion; and a plurality of channels including the channel, where each channel comprises a recessed portion of the surface of the bristle portion of the brush and is configured to receive the portion of the flange;

where the channel has a length that extends in a longitudinal direction of the brush from a first end of the bristle portion to a second end of the bristle portion, the first end opposite the second end;

where the first channel opening is positioned at the first end of the bristle portion and the second channel opening is positioned at the second end of the bristle portion; and where the channel is defined by one or more sidewalls of the surface, a bottom wall of the surface, or both.

3. The system of claim 2, where the brush further comprises:

a handle portion coupled to the bristle portion, the handle portion includes a first lead in feature that is aligned with the channel; and an end cap coupled to the bristle portion, the end cap includes a second lead in feature that is aligned with the channel, where the bristle portion is positioned intermediate the handle portion and the end cap;

where the channel is straight between the first end of the bristle portion and the second end of the bristle portion, where first end of the bristle portion positioned between the handle portion and the second end of the bristle portion, and where at least one of the first lead in feature or the second lead in feature is tapered to expand in a direction away from the channel.

4. The system of claim 2, where the cleaner assembly comprises:

a plurality of flanges coupled to the frame and including the flange, where the plurality of flanges is configured to be inserted into the plurality of channels, and where the plurality of flanges further includes:

a first flange coupled to the frame and comprising another cutter, at least a portion of the first flange configured to be inserted into and travel within a first channel of the plurality of channels such that the other cutter cuts hairs during travel of the portion of the first flange within the first channel; and a second flange coupled to the frame and comprising a groove configured to collect at least one hair, the second flange configured to, during travel of at least a portion of the second flange within a second channel of the plurality of channels, lift hairs in a direction away from the brush and to collect at least a portion of the hairs in the groove; and a plurality of protrusions coupled to the frame, where at least a portion of the plurality of protrusions is positioned between the first flange and the second flange, the plurality of protrusions configured to remove hairs from a plurality of bristles of the brush during travel of the flange within the channel.

5. The system of claim 4, where a protrusion of the plurality of protrusions is configured to travel between a first row of bristles of the plurality of bristles and a second row of bristles of the plurality of bristles during travel of the portion of the flange within the channel, where the frame of the cleaner assembly includes a first opening and a second opening, where the flange is positioned between the first opening and the second opening, and wherein each of the first opening and the second opening is sized and configured such that a first end of the brush followed by a second end of the brush can pass through the first and second openings.

6. A system for removing hair accumulated in bristles of a brush, the system comprising:

a brush comprising a plurality of bristles and a channel including a first channel opening and a second channel opening; and a cleaner assembly extending about at least a partial circumference of the brush, the cleaner assembly comprising a frame and a flange coupled to the frame, where at least a portion of the flange is configured, during a cleaning operation, to be inserted into the channel via the first channel opening, to travel within the channel and lift hair in a direction away from the brush as the portion of the flange travels within the channel, to be removed from the channel via the second channel opening.

7. The system of claim 6, where the brush further comprises:

a bristle portion having a surface, where the channel comprises a recessed portion of the surface of the bristle portion of the brush, and where at least a portion of each bristle of the plurality of bristles extends from or through the surface of the bristle portion.

8. The system of claim 7, where the brush further comprises:

a second channel, the second channel comprising a recessed portion of a second surface of the bristle portion of the brush, where the second surface of the bristle portion distinct from the surface of the bristle portion; and where the bristle portion comprises a metal having a ceramic coating.

9. The system of claim 7, where the channel has a length that extends in a longitudinal direction of the brush from a first end of the bristle portion to a second end of the bristle portion, the first end opposite the second end, and where the channel is straight between the first end of the bristle portion and the second end of the bristle portion.

10. The system of claim 6, where the brush further comprises:

a plurality of channels including the channel, and where each channel is configured to receive the portion of the flange; and where the portion of the flange comprises a rubber end configured to travel within the channel.

11. The system of claim 6, where:

the brush further comprises a plurality of channels including the channel; and the cleaner assembly further comprises:

a plurality of flanges coupled to the frame and including the flange, where the plurality of flanges is configured to be inserted into the plurality of channels; and a plurality of protrusions coupled to the frame and configured to collect one or more hairs from the plurality of bristles.

12. The system of claim 6, where the frame of the cleaner assembly includes a first opening and a second opening, and where the flange is positioned between the first opening and the second opening, and wherein each of the first opening and the second opening is sized and configured such that a first end of the brush followed by a second end of the brush can pass through the first and second openings.

13. The system of claim 12, where the flange includes a first cutter configured to cut the hair, where a first edge of the first cutter faces the first opening, and where a second edge of the first cutter faces the first opening.

14. The system of claim 12, where the flange includes a first cutter configured to cut the hair, where a first edge of the first cutter faces the first opening, where the flange includes a second cutter, and where a second edge of the second cutter faces the second opening.

15. The system of claim 6, where the flange includes a first groove configured to collect one or more hairs, the first groove facing the first opening, where the cleaner assembly includes another flange that includes a second groove configured to collect one or more hairs, the second groove facing the first opening or the second opening.

16. A brush for operation with a cleaner assembly to remove hair accumulated in bristles of the brush, the brush comprising:

a plurality of bristles including a first set of bristles and a second set of bristles;

a bristle portion having a surface, where at least a portion of each bristle of the plurality of bristles extends through the surface of the bristle portion; and a channel comprising a recessed portion of the surface of the bristle portion of the brush that is positioned between the first and second set of bristles, the channel including a first channel opening at a first end of the channel and a second channel opening at a second end of the channel;

where the channel is configured to:

receive at least a portion of a flange of a cleaner assembly into the channel via the first channel opening such that a frame of the cleaner assembly coupled to the flange extends about a least a partial circumference of the bristle portion when the flange is positioned within the channel;

enable the portion of the flange to travel within the channel such that the cleaner assembly lifts hair in a direction away from the brush as the portion of the flange travels within the channel; and enable removal of the portion of the flange from the channel via the second channel opening.

17. The brush of claim 16, further comprising:

a handle portion coupled to the bristle portion; and an end cap coupled to the bristle portion, where the bristle portion is positioned intermediate the handle portion and the end cap.

18. The brush of claim 17, where the surface of the bristle portion comprises a plurality of openings through which the plurality of bristles extend, where the bristle portion comprises ceramic, and where the bristle portion comprises a barrel shape or a flat shape.

19. The brush of claim 17, further comprising:

a coupler comprising a first end coupled to the handle portion and a second end coupled to the end cap, where the coupler extends through the bristle portion, where the coupler is coupled to the plurality of bristles, and where a portion of each bristle of the plurality of bristles extends through a corresponding opening of a plurality of openings of the bristle portion;

a screw coupled to the handle portion and the end cap, where the screw, when coupled to the handle portion and the end cap is configured to secure the bristle portion between the handle portion and the end cap; or both the coupler and the screw.

20. A cleaner assembly for operation with a brush to remove hair accumulated in bristles of the brush, the cleaner assembly comprising:

a frame configured to be removably coupled to a brush during a cleaning operation;

a first flange coupled to the frame and comprising a cutter, at least a portion the first flange configured to be inserted into a first channel opening of a recessed channel of a brush positioned between a first set of bristles and a second set of bristles of the brush to travel within the recessed channel and enable the cutter to cut one or more hairs coupled to the first and second set of bristles during travel of the portion of the flange within the recessed channel, and to be removed from the recessed channel via a second channel opening of the recessed channel; and a plurality of protrusions coupled to the frame and configured to remove the one or more hairs from a plurality of bristles of the brush during travel of the portion of the flange within the recessed channel.

21. The cleaner assembly of claim 20, where the frame includes a first end and a second end that is opposite the first end, and where the first end faces a direction of travel of the first flange when the portion of the first flange is positioned within the recessed channel.

22. The cleaner assembly of claim 21, where the first end comprises a first surface that includes a first opening, the second end comprises a second surface that includes a second opening, and the first flange and the plurality of protrusions are positioned between the first opening and the second opening.

23. The cleaner assembly of claim 20, where a protrusion of the plurality of protrusions is configured to travel between a first row of bristles of the brush and a second row of bristles of the brush during travel of the portion of the flange within the recessed channel, and where at least one protrusion of the plurality of protrusions includes a cleaner bristle, a cleaner fin, a cleaner hook, or a combination thereof.

24. The cleaner assembly of claim 20, further comprising:

a second flange coupled to the frame and comprising a groove configured to collect at least one hair, the second flange configured to, during travel of the portion of the flange within the recessed channel, lift the one or more hairs in a direction away from the brush and to collect at least a portion of the one or more hairs in the groove.

25. The cleaner assembly of claim 24, where at least a portion of the second flange is configured to be inserted into and travel within a second recessed channel of the brush, and where at least a portion of the plurality of protrusions is positioned between the first flange and the second flange.

* * * * *